US011858710B2

(12) United States Patent
Fiere

(10) Patent No.: US 11,858,710 B2
(45) Date of Patent: Jan. 2, 2024

(54) SPOUTED POUCH PROVIDED WITH A CLOSURE DEVICE

(71) Applicant: Scholle IPN IP B.V., SX Tilburg (NL)

(72) Inventor: Jeroen Pieter Fiere, 's-Gravendeel (NL)

(73) Assignee: SCHOLLE IPN IP BV, Tilburg (NL)

( * ) Notice: Subject to any disclaimer, the term of this patent is extended or adjusted under 35 U.S.C. 154(b) by 37 days.

(21) Appl. No.: 17/298,912

(22) PCT Filed: Nov. 21, 2019

(86) PCT No.: PCT/NL2019/050768
§ 371 (c)(1),
(2) Date: Jun. 1, 2021

(87) PCT Pub. No.: WO2020/111939
PCT Pub. Date: Jun. 4, 2020

(65) Prior Publication Data

US 2022/0055815 A1 Feb. 24, 2022

(30) Foreign Application Priority Data

Nov. 29, 2018 (NL) ..... 2022097

(51) Int. Cl.
*B65D 75/58* (2006.01)
*B65D 41/34* (2006.01)
(Continued)

(52) U.S. Cl.
CPC ..... *B65D 75/5883* (2013.01); *B65D 41/3409* (2013.01); *B65D 47/0809* (2013.01); *B65D 47/2031* (2013.01); *B65D 2401/30* (2020.05)

(58) Field of Classification Search
CPC ..... B65D 75/5883; B65D 41/3409; B65D 47/0809; B65D 47/2031; B65D 2401/30;
(Continued)

(56) References Cited

U.S. PATENT DOCUMENTS

2017/0217652 A1* 8/2017 Genaw, Jr. ..... B65D 47/06
2019/0023479 A1* 1/2019 Sade ..... B65D 75/5883
(Continued)

FOREIGN PATENT DOCUMENTS

EP 2888489 B1 9/2017
KR 101764132 B1 8/2017
(Continued)

*Primary Examiner* — Shawn M Braden
(74) *Attorney, Agent, or Firm* — The Watson IP Group, PLC; Jovan N. Jovanovic

(57) ABSTRACT

A spouted pouch has a spout (10) having an exterior surface provided with a first screw thread (21). The spout body is provided with a rotation preventing boss (25, 26). A closure device (40) secured on the neck and comprises: —a socket (50; 150) configured to the screwed onto the neck (12) of the spout (10), —a user openable or user removable cap (70; 170) supported on the socket in a manner so as to be openable or removable relative to the socket (50; 150). The socket has a bore (52) with a second screw thread (56) that cooperates with the first screw thread upon screwing the socket onto the neck. An upper section of the exterior surface of the socket body defines a discharge portion (53). At a lower end the socket body is provided with a permanent snap lock anti-back off structure (60) comprising a portion (61, 63; 161, 162) that is configured to flex over the rotation preventing boss (25, 26) upon screwing of the socket onto the neck and then snap behind said boss. This structure is configured to remain intact upon a user opening or removing the cap for the first time. The cap (70; 170), in a closed position thereof, covers the discharge portion (53) and in an opened or removed position clears the discharge portion (53).

13 Claims, 23 Drawing Sheets

Figure 1:
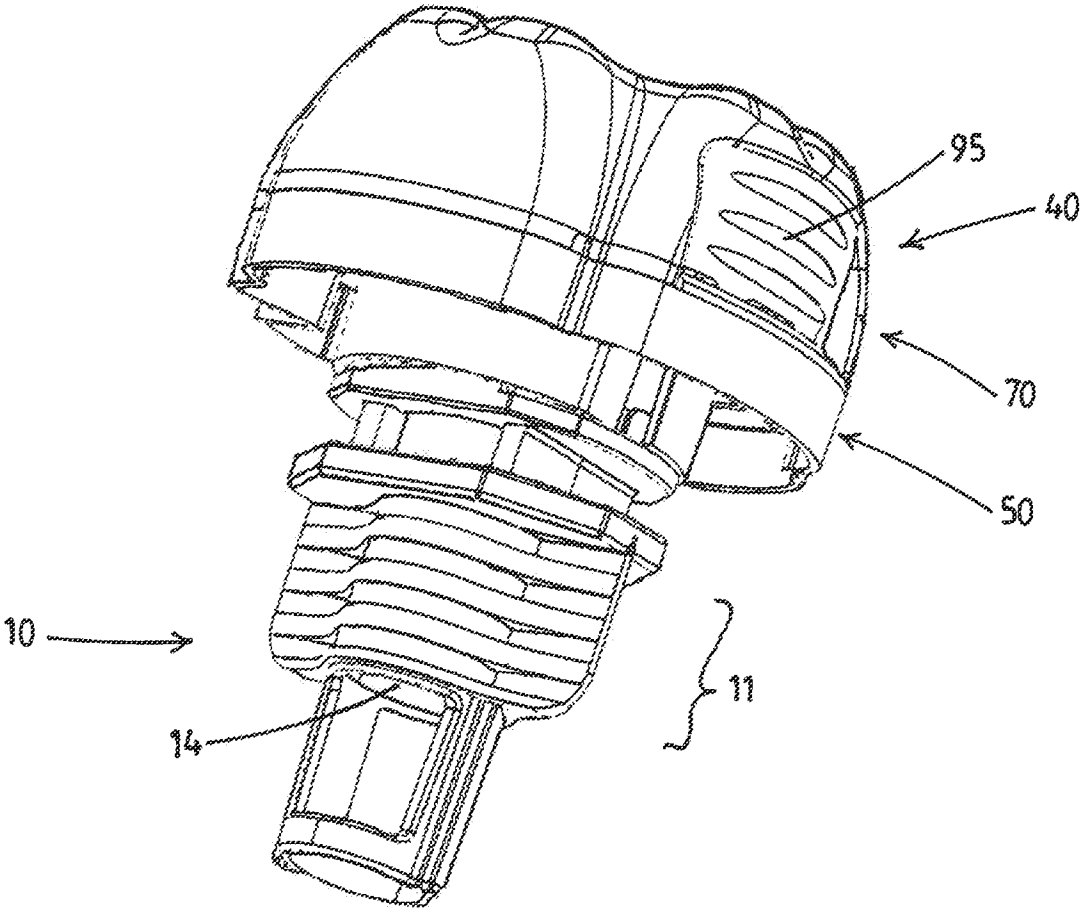

(51) Int. Cl.
*B65D 47/08* (2006.01)
*B65D 47/20* (2006.01)

(58) Field of Classification Search
CPC ..... B65D 2575/583; B65D 75/008; B65D 2251/0015; B65D 75/5872; B65D 85/72
See application file for complete search history.

(56) References Cited

U.S. PATENT DOCUMENTS

| | | | | |
|---|---|---|---|---|
| 2019/0084735 | A1* | 3/2019 | Berge | B65D 75/5883 |
| 2020/0255203 | A1* | 8/2020 | Roemer | B65D 75/5883 |
| 2020/0307886 | A1* | 10/2020 | Tamarindo | B65D 47/061 |
| 2020/0324946 | A1* | 10/2020 | Harding | B65D 51/18 |

FOREIGN PATENT DOCUMENTS

| | | | |
|---|---|---|---|
| WO | 2014007612 | A1 | 1/2014 |
| WO | 2017035037 | A1 | 3/2017 |
| WO | 2017052364 | A1 | 3/2017 |

* cited by examiner

SPOUTED POUCH PROVIDED WITH A CLOSURE DEVICE

The present invention relates to the field of spouted pouches having a spout with a neck and a closure device secured on the neck of the spout.

For example, WO2014/007612 discloses a spouted pouch having a flexible material pouch body provided with a spout having a unitary molded spout body of plastic material. The spout body has at a lower end thereof an attachment portion that is attached to the pouch body, e.g. between opposed film walls of the pouch. The spout body has at an upper end thereof a tubular neck, which neck has an interior surface delimiting at least a section of a product passage that extends from a lower product passage opening through the spout body to discharge opening at a top end of the neck. The neck has an exterior surface with a smooth upper section that may be used as a mouthpiece and for example placed between the lips of a user for drinking the product that has been filled into the pouch. The neck also has a lower section of the exterior surface where the neck is provided with an external screw thread. A rotational cap is provided that is secured on the neck in order to close the product passage in the closed position thereof. As elucidated in detail in this prior art document the spout body is provided with an integrally molded rotation preventing boss with a catch portion at a location outward of the neck and below the external screw thread. This design is such that—upon rotating the cap in opening direction by the user from its closed position for the first time—the head end of an indicator portion of the tamper-evident ring of the cap enters a recess of the catch portion and is then prevented from further motion in opening direction of the cap, whilst the catch portion outer wall comes in the spacing between the spaced apart head end and trailing end, a frangible bridge between said head end and trailing end breaking and the indicator portion bending, folding, and/or buckling whilst being subjected to permanent deformation upon further rotation of the cap in opening direction.

The present invention aims to provide an improved spouted pouch, at least to provide an alternative for known spouted pouches.

The present invention achieves one or more of the above-mentioned objects by providing a spouted pouch according to claim 1.

In the inventive spouted pouch the closure device not only comprises the user openable or user removable cap, but also a socket that is configured to the screwed onto the neck of the spout, wherein the user openable or user removable cap is supported on the socket in a manner so as to be openable or removable relative to the socket.

The socket comprises a molded socket body of plastic material having a bore extending through the socket body from a lower end of the socket to a discharge opening at a top end of the socket, wherein the bore is configured to receive at least a portion of the neck of the spout therein. The bore has an interior surface provided with a second screw thread that is configured to cooperate with the first screw thread upon screwing the socket onto the neck of the spout.

The socket body has an exterior surface of which at least an upper section defines a discharge portion having the discharge opening.

The socket body is provided at the lower end thereof with a permanent snap lock anti-back off structure comprising at least one permanent snap lock anti-back off portion that is configured to flex over the rotation preventing boss upon screwing of the socket onto the neck of the spout and then snap behind said rotation preventing boss. The permanent snap lock anti-back off structure is configured to remain intact upon a user opening or removing the cap.

The cap, in a closed position thereof, covers the discharge portion and in an opened or removed position clears the discharge portion to allow for dispensing of the product from the pouch. The discharge portion can be embodied as a mouthpiece so that a user may put the mouthpiece between the lips and drink the product directly out of the pouch.

In general terms, the opening or removal of the cap by the user does not alter the situation that the socket remains securely screwed on the neck of the spout as the permanent snap lock anti-back off structure prevents unscrewing of the socket from the neck of the spout.

In an embodiment, the permanent snap lock anti-back off portion is configured to flex radially outward when passing over the rotation preventing boss and then snap radially inward behind the rotation preventing boss.

In another embodiment, the permanent snap lock anti-back off portion is configured to flex axially upward when passing over the rotation preventing boss and then snap downward behind the rotation preventing boss.

In embodiments, the closure device is provided with a tamper-evident structure that is configured to visually evidence the first time opening or removal of the cap by the user. For example, the tamper-evident structure includes one or more breakable bridges that break upon first time opening or removal of the cap by the user. As the permanent snap lock anti-back off structure remains intact, it is this tamper-evident structure of the closure device that informs the user, e.g. consumer of a product for human consumption that has been filled into the pouch, whether the pouch has already been opened or not.

In embodiments, a valve member, e.g. a slit valve member, is provided that is normally closed to close off the product passage and that opens upon application of suitable pressure across the valve member, e.g. upon squeezing the pouch and/or providing suction on the mouthpiece.

In embodiments, the slit valve member is, for example:

- retained in the socket or in the spout, e.g. circumferentially retained in a groove of the socket or the spout,
- retained, e.g. clamped, between the socket and the neck of the spout,
- co-molded onto the socket, e.g. using 2K-injection molding techniques.

The provision of a self-closing valve, e.g. a slit valve, for example, allows for the packaging of easily flowing, low viscosity, products in the pouch without undue risk of inadvertent spillage. For example, a low viscosity beverage, such as water or the like, can be filled in the pouch.

For example, a slit valve member is made of silicone material or a thermoplastic elastomer material.

In a preferred embodiment, the closure device is a hinged cap closure device, wherein the cap is a hinged cap, that is hinged to the socket. In an embodiment the socket and the hinged cap are integrally molded from plastic material with an intermediate hinge, e.g. a living hinge, between the socket and the hinged cap. This unitary closure device is thus screwed onto the neck of the spout, e.g. after filling the product into the pouch via the neck. In another embodiment of a hinged cap closure device the cap and socket are made separately, e.g. each by injection molding of plastic material, and then the cap is mounted onto the socket. Herein first hinge formations on the socket cooperate with second hinge formations on the cap.

In a practical embodiment, the socket body has a tubular body portion defining said bore extending through the socket body from a lower end of the socket to a discharge opening at a top end of the tubular body portion. The socket body has a deck portion forming a deck surface about the tubular body portion. An upper section of the tubular body portion extending above the deck surface defines the discharge portion having the discharge opening. A lower section of the tubular body portion extends below the deck portion. Herein, preferably, the second screw thread is provided in said lower section of the tubular body portion. Optionally the cap is a hinged cap that is integrally molded from plastic material with the socket and wherein an intermediate hinge, e.g. a living hinge, is present between the deck portion and the hinged cap. The deck portion may in practical use determine the effective length of the mouthpiece, so the length over which one puts the mouthpiece into the mouth. For example the mouthpiece is devoid of any screw thread or the like, at least over a height of 1.5 centimeters from the top.

In embodiments, the socket body has a tubular body portion defining at least a section of the bore, wherein the socket body has a deck portion forming a deck surface about the tubular body portion, wherein a lower section of the tubular body portion extends below the deck portion, wherein the cap is a hinged cap, that is hinged to the deck portion, for example wherein the socket and the hinged cap are integrally molded from plastic material with an intermediate hinge, e.g. a living hinge, between the deck portion and the hinged cap. In the closed position thereof, a lower edge of the hinged cap adjoins the deck portion, e.g. along an outer perimeter thereof.

In an embodiment, the hinged cap is provided with an inward depressable button portion that is integrally molded with at least the hinged cap and is supported in the cap via one or more button hinge portions of the cap, wherein a tamper-evident structure is associated with the inwardly depressable button portion to evidence the first time opening of the hinged cap. So the user, desiring to open the hinged cap, will press the button portion inward.

In an embodiment, the inward depressable button portion has a lower edge, wherein an integrally molded latch portion extends downward from the lower edge with one or more breakable bridges being present between the button portion and the latch portion. The deck portion of the socket body is provided with a latch portion receiving structure having an opening into which said latch portion is introduced upon first time closing of the cap and being configured to retain the latch portion so that upon first time opening of the hinged cap by a user said one or more breakable bridges break with the latch portion being retained thereby evidencing said first time opening.

In an embodiment, the socket has a deck portion, e.g. also with a hinged cap, and the spout is provided with two rotation preventing bosses at diametrically opposed locations relative to the neck, wherein the socket is provided with two permanent snap lock anti-back off portions, e.g. substantially semi-circular shaped in plan view, that each integrally adjoin the deck portion at a top end thereof and extend substantially downward from the deck portion, radially outward relative to the lower section of the tubular portion of the socket, e.g. concentric, which anti-back off portions are each configured to flex radially outward when passing over the rotation preventing boss and then snap radially inward behind the rotation preventing boss with a head end of the anti-back off portion facing the rotation preventing boss.

In a variant thereof, each boss has a catch portion having or forming a recess at a side of the boss facing the head end and having an catch portion outer wall with an outer face that is arranged along an inner face of the substantially semi-circular permanent snap lock anti-back off portions when the socket is screwed onto the neck, such that—upon an attempt to unscrew the socket from the neck of the spout by a user, e.g. in the course of rotating a rotational cap in opening direction by the user from its closed position for the first time, the head end enters the recess of the catch portion and is then prevented from further motion so as to keep the socket on the neck.

In an embodiment, the cap comprises a central sealing portion having an annular sealing surface, wherein the discharge portion comprises an annular sealing surface, said sealing surfaces being configured to sealingly engage one another in the closed position of the hinged cap. For example in an embodiment wherein a slit valve member is present, the annular sealing surface of the discharge portion is arranged above the slit valve member, e.g. the socket having an inward bend end portion of which an inner face defines the annular sealing surface, e.g. with said inward bend end portion defining a circumferential groove in which at least an retention portion of a slit valve member is retained. In an embodiment the hinged cap has a central depression which forms the central sealing portion and the annular sealing surface thereof, the depression forming a recess in an exterior top face of the hinged cap. In an embodiment, the central depression is configured to extend closely along or be in contact with the slit valve member, at least in a zone thereof wherein said one or more slits of the slit valve member are present. Hereby opening of the slit valve due to pressurization of the product in the pouch is blocked as long as the hinged cap is in place and the product will not be able to pass the slit valve.

In an embodiment, a lower edge of the socket is provided with one or more, e.g. two, downward projecting abutment portions having an abutment face, and the one or more rotation preventing bosses of the spout are each embodied with an abutment portion having an abutment face, so that upon screwing the socket onto the neck each abutment portion of the socket abuts against the corresponding abutment face of the boss and thereby defines the position of the socket fully screwed onto the neck.

In an embodiment, the socket body has a tubular body portion defining at least a section of the bore that extends through the socket body, which tubular body portion has a lower section, wherein the spout is provided with two rotation preventing bosses at diametrically opposed locations relative to the neck, and wherein the socket is provided with two permanent snap lock anti-back off portions which are located radially outward relative to the lower section of the tubular portion of the socket, which anti-back off portions are each configured to flex radially outward when passing over the rotation preventing boss upon screwing the socket onto the neck and then snap radially inward behind the rotation preventing boss with a head end of the anti-back off portion facing the rotation preventing boss. In a further development hereof, preferably, the socket is provided with two downward projecting abutment portions, that are each embodied as a downward extensions of the lower section of the tubular portion of the socket, each abutment portion having an abutment face, and wherein the one or more rotation preventing bosses of the spout are each embodied with an corresponding abutment portion having an abutment face, so that upon screwing the socket onto the neck each abutment portion of the socket abuts against the corresponding abutment face of the boss and thereby defines the position of the socket fully screwed onto the neck.

In an embodiment, each abutment portion extends as a semi-circular portion about a main axis of the socket, e.g. concentrically about a lower section of a tubular body portion of the socket, and has a lower end face slanting upwards from the lower end of the abutment face. This allows for a sturdy design of the abutment portion whilst ensuring that the lower end face passes over the bosses of the spout during screwing the socket onto the neck.

In another embodiment, the closure device is not a hinged cap type device but a screw cap type device. In embodiments thereof the socket is provided with an external screw thread at a location below the discharge portion, and the cap is a rotational cap, or screw cap, that is secured on the socket, the cap covering the discharge portion and, preferably, sealing the product passage in closed position of the cap on the socket, and the cap—for removal of the cap by a user to open the product passage—being adapted to be manually rotated from the closed position in an opening direction. Herein the cap comprises a top wall and a downward depending skirt, said skirt having an interior side, an exterior side, and a lower edge remote from the top wall. The interior side of the skirt has an internal screw thread adapted to cooperate with the external screw thread of the socket.

In an embodiment, the cap is a rotational cap, e.g. a screw cap, or a snap cap, wherein a strap connects the cap to the socket so that after opening of the closure device the cap remains attached to the socket. For example, as preferred, the socket, strap, and cap are injection molded together as a one-piece plastic component.

In embodiments, the rotational cap and the socket are provided with cooperating tamper-evident portions forming a tamper-evident structure of the closure device, wherein the tamper-evident structure includes one or more breakable bridges that break upon rotating the cap in opening direction by the user from its closed position for the first time, wherein the permanent snap lock anti-back off structure is configured to remain intact upon a user opening or removing the cap for the first time.

In a variant, the socket is provided with a integrally molded rotation preventing boss below the external thread on the socket, e.g. two rotation preventing bosses at diametrically opposed locations relative to the tubular portion of the socket, wherein a tamper-evident ring is integrally molded to the skirt of the rotational cap, said tamper-evident ring being composed of at least two ring segments, each ring segment having a base portion and an indicator portion, wherein the base portion is connected via one or more non-frangible connector portions to the skirt, said base portion extending from a trailing end thereof in opening direction over a base portion angle about a main axis, said base portion having an inner face with an inner face radius about the main axis, and wherein the indicator portion is connected at the head end thereof via an integrally molded frangible bridge to an adjacent trailing end of a base portion of another ring segment, wherein the spout has for each ring segment of the tamper-evident ring a rotation preventing boss, said boss being arranged to be engaged by a corresponding head end of an indicator portion of the segment, wherein the cap with tamper-evident ring is embodied such that upon rotating the cap in opening direction by the user from its closed position for the first time, the head end of the indicator portion engages the boss which then prevents the head end from further motion in opening direction of the cap, the frangible bridge between said head end and the trailing end of the base portion breaking, and the indicator portion being subjected to permanent deformation.

In a variant thereof, each rotation prevention boss has a catch portion having a recess at a side of the boss facing the head end of the indicator portion and having an catch portion outer wall with an outer face that is arranged along the inner face of the base portion near the trailing end thereof when said cap is in its closed position, and the head end of the indicator portion is arranged at a spacing radially inward from the trailing end of the adjacent base portion when said cap is in its closed position, such that—upon rotating the cap in opening direction by the user from its closed position for the first time—the head end of the indicator portion enters the recess of the catch portion and is then prevented from further motion in opening direction of the cap, whilst the catch portion outer wall comes in the spacing between the spaced apart head end and trailing end, the frangible bridge between said head end and trailing end breaking and the indicator portion bending, folding, and/or buckling whilst being subjected to permanent deformation upon further rotation of the cap in opening direction.

In embodiments, the spout is provided with two rotation preventing bosses at diametrically opposed locations relative to the neck, wherein the socket comprises two diametrically opposed flange portions that each extend radially outward from a lower section of the socket, e.g. below an external thread on the socket. Herein each flange portion has an end facing in a direction counter to the external screw thread, and at each of said ends of the flange portions a permanent snap lock anti-back off portion protrudes in said direction counter to the external screw thread. Each anti-back off portion is configured to flex axially upward when passing over the rotation preventing boss and then snap downward behind the rotation preventing boss.

The present invention also relates to a closure device as described herein and adapted to be secured or secured on a tubular neck of a spout of a spouted pouch. The closure device may have one or more features as discussed herein, e.g. as in the appended claims.

The present invention also relates to a closure device adapted to be secured or secured on a tubular neck of a spout, e.g. the spout of a spouted pouch, which spout has a spout body including a tubular neck, which neck has an interior surface delimiting at least a section of a product passage that extends from a lower product passage opening through the spout body to an upper opening at a top end of the neck, said neck having an exterior surface provided with a first screw thread, wherein the spout body is provided with a rotation preventing boss at a location outward of the neck and below said first screw thread, wherein said closure device comprises:

a socket configured to the screwed onto the neck of the spout, a user openable or user removable cap supported on the socket in a manner so as to be openable or removable relative to the socket, wherein the socket comprises a molded socket body of plastic material having a bore extending through the socket body from a lower end of the socket to a discharge opening at a top end of the socket, wherein the bore is configured to receive at least a portion of the neck of the spout therein, and wherein the bore has an interior surface provided with a second screw thread that is configured to cooperate with the first screw thread upon screwing the socket onto the neck of the spout, wherein the socket body has an exterior surface of which at least an upper section defines a discharge portion having said discharge opening, wherein the socket body is provided at the lower end thereof with a permanent snap lock anti-back off structure comprising at least one permanent snap lock anti-back off portion that is configured to flex over the rotation preventing boss upon screwing of the socket onto the neck of the spout and then snap behind said rotation preventing boss, wherein said permanent snap lock anti-back off structure is configured to remain intact upon a user opening or removing the cap for the first time, wherein the cap, in a closed position thereof, covers the discharge portion.

The closure device may have one or more features as discussed herein, e.g. as in the appended claims.

The present invention also relates to a method for providing spouted pouches filled with a product, wherein spouted pouches provided with a spout are supplied to a filling device in a state wherein the closure device is not yet secured on the neck, wherein the filling devices fills a spouted pouch through the product passage in the neck of the spout, and wherein upon the filling being completed, a closure device is secured on the spout by a screwing device, wherein the socket is screwed onto the neck such that the at least one permanent snap lock anti-back off portion of the permanent snap lock anti-back off structure flexes over the rotation preventing boss and then snap behind the rotation preventing boss.

The present invention also relates to a method of manufacturing a spouted pouch according to the invention.

The present invention also relates to a method of manufacturing and filling of a spouted pouch comprising the steps of:

providing a pouch body provided with the spout as described herein, filling the pouch via the product passage in the spout, screwing the socket, e.g. already provided with the cap to form a pre-assembled closure device, onto the neck of the spout, e.g. using an automated cap screw device.

The invention will now be explained with reference to non-limiting as shown in the drawings.

Figure 2:
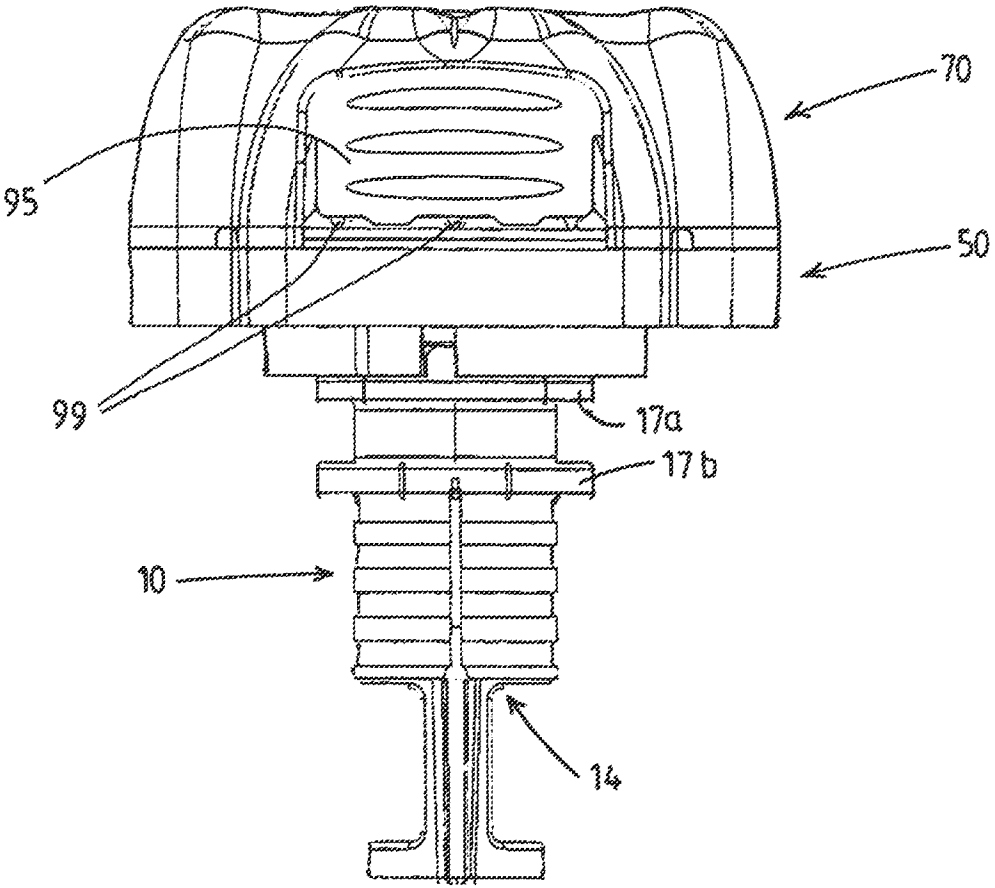
Figure 3:
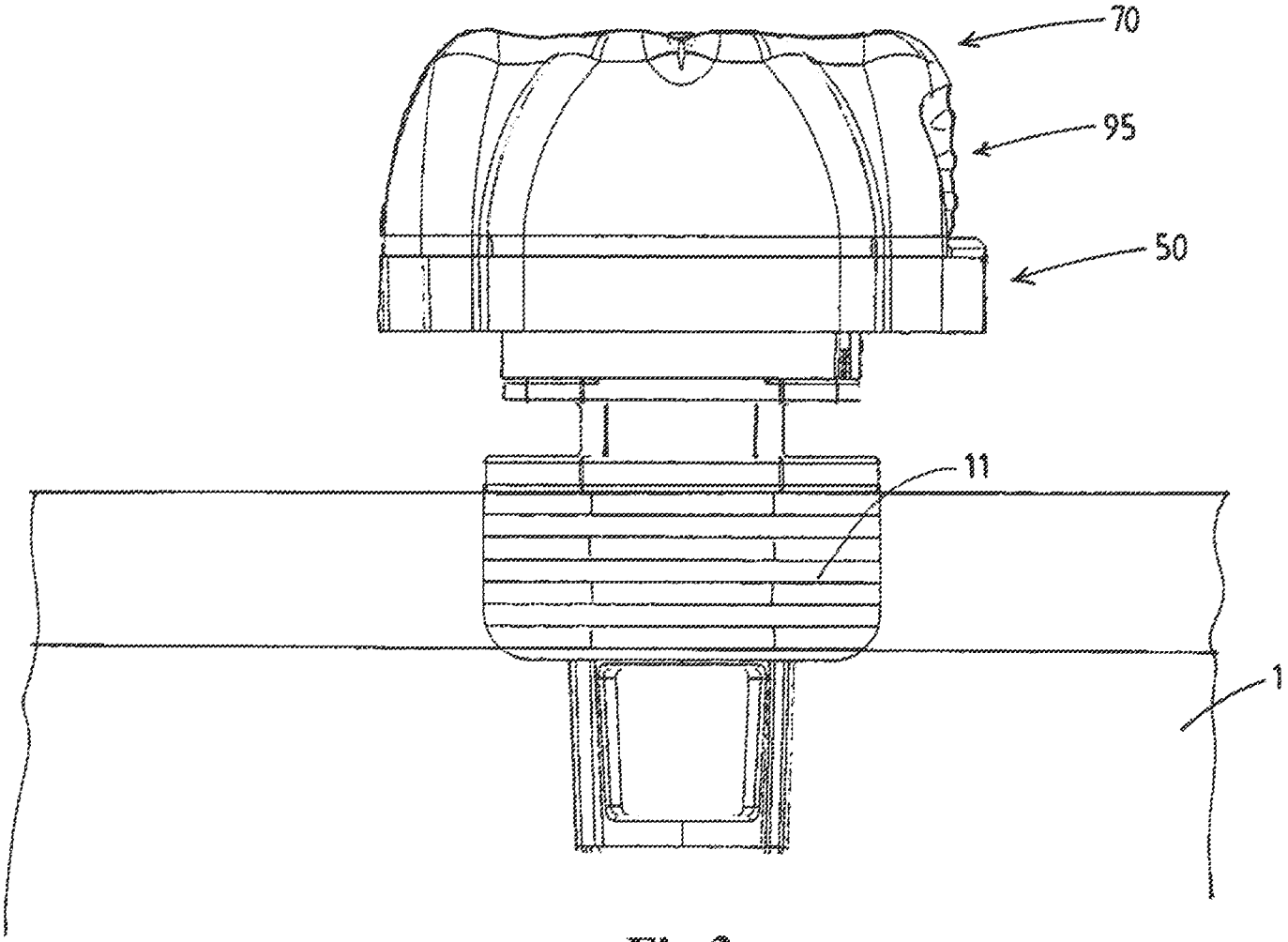
Figure 4:
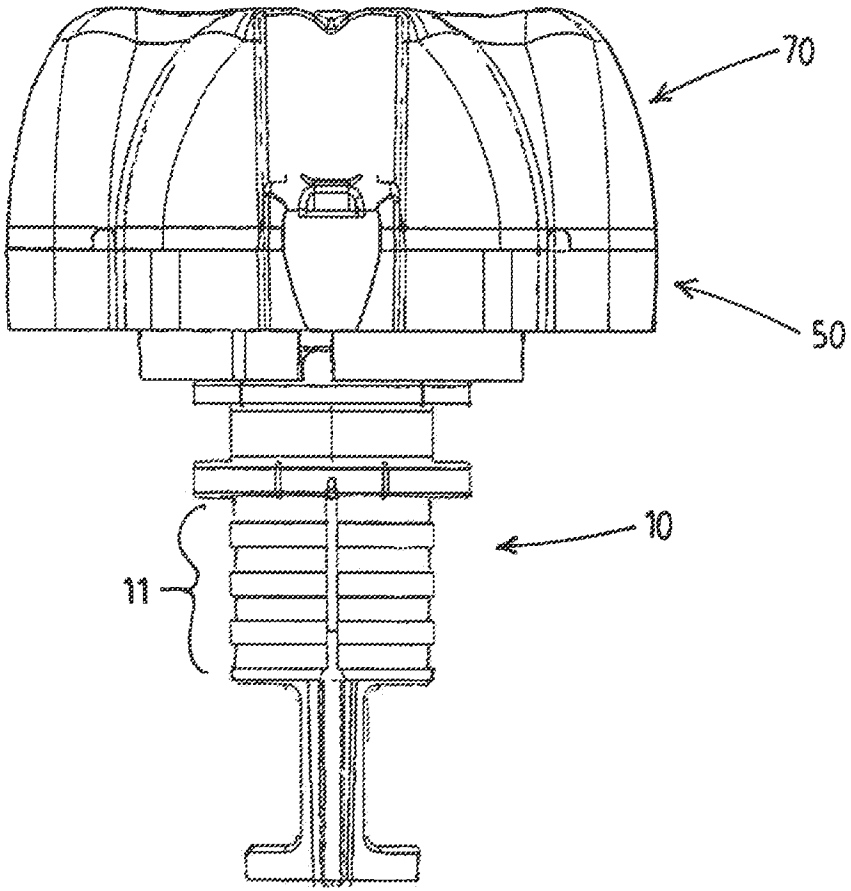
Figure 5:
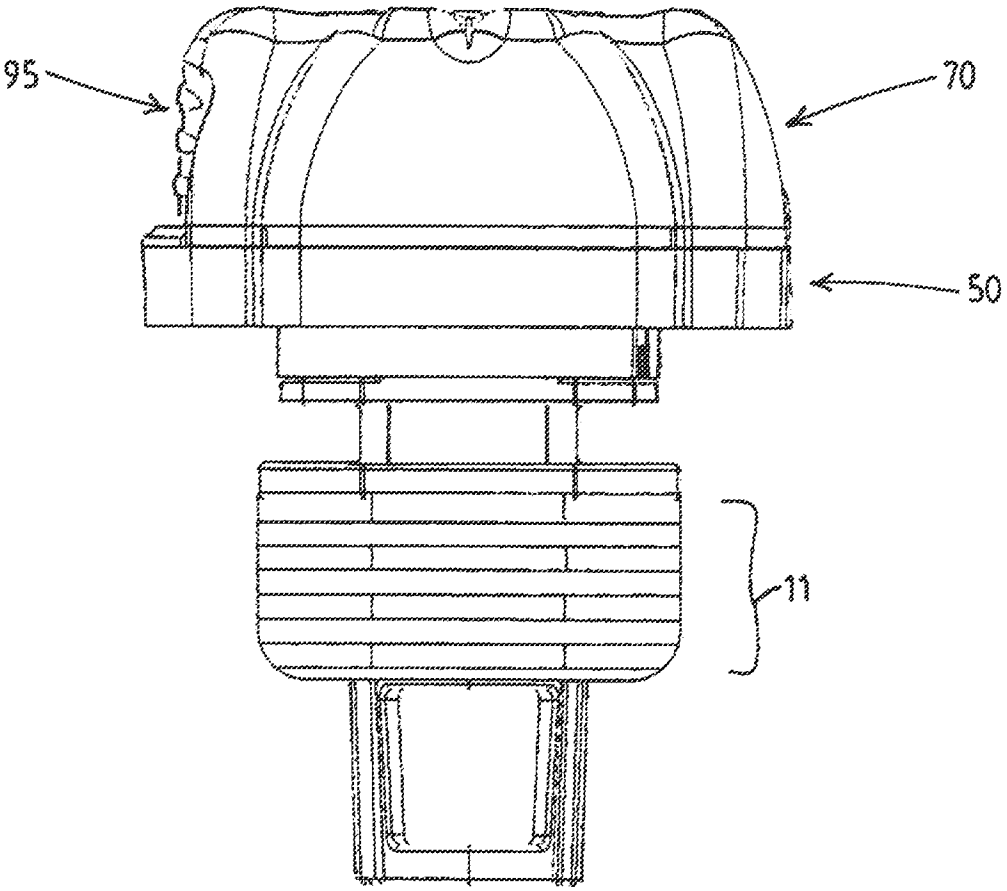
Figure 6:
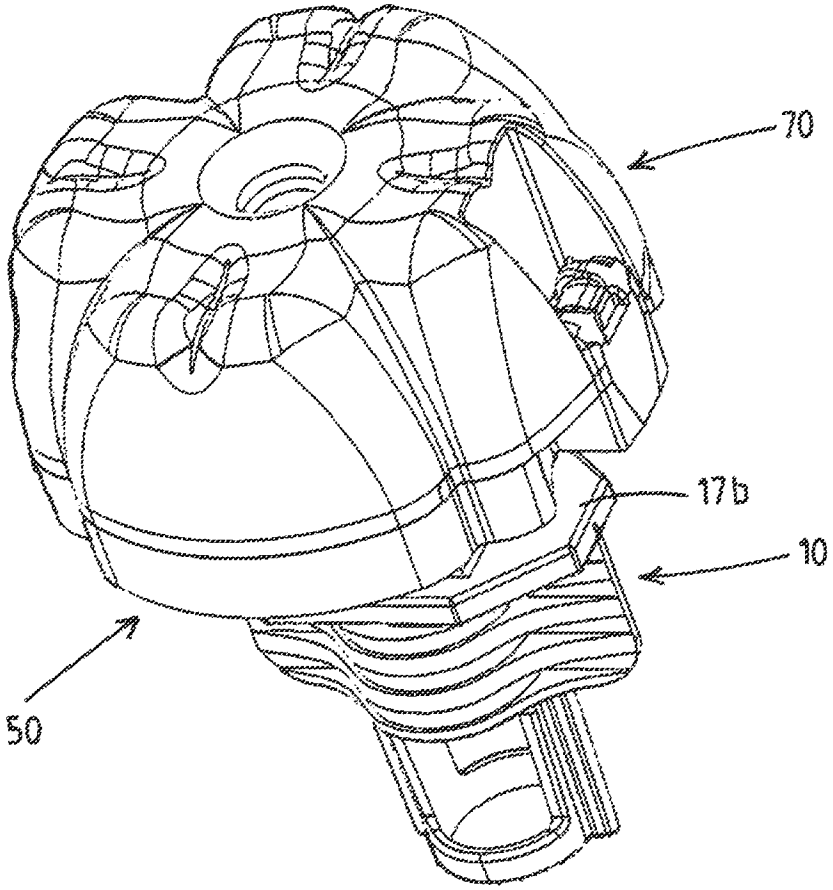
Figure 7:
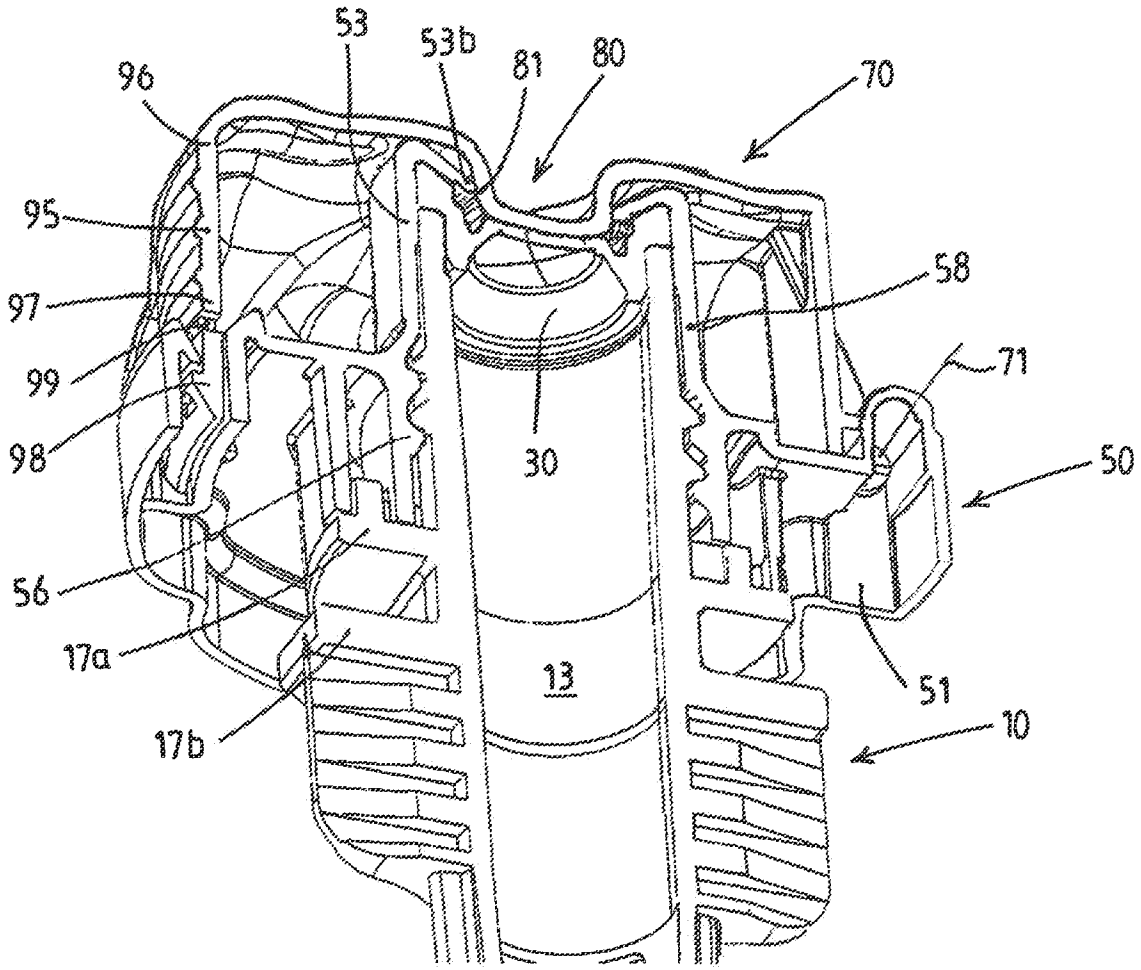
Figure 8:
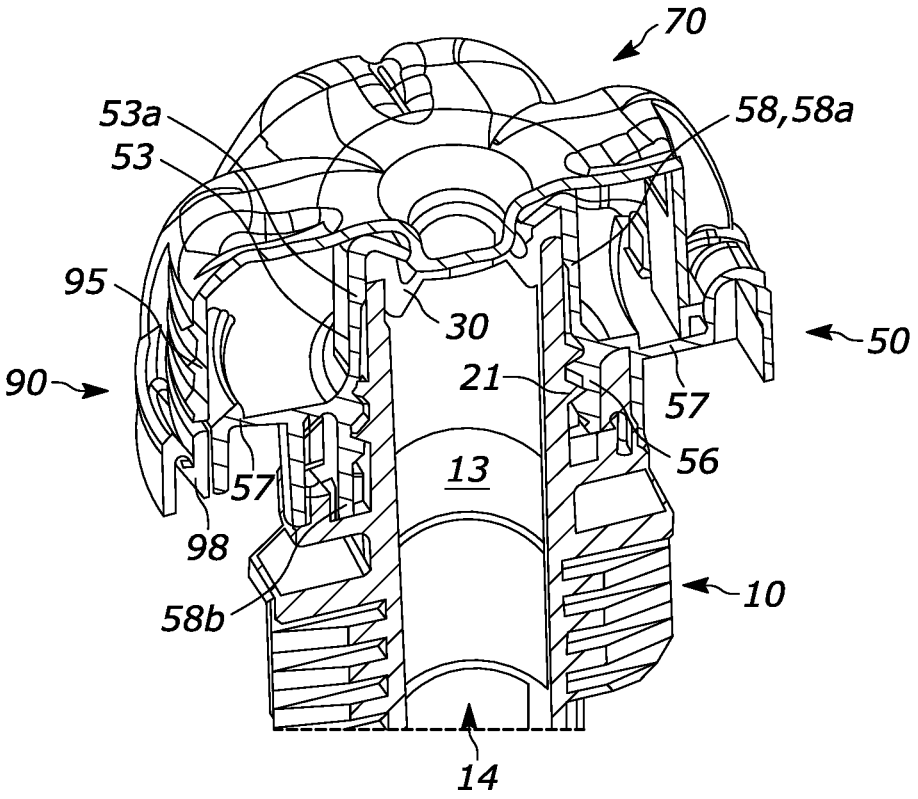
Figure 9:
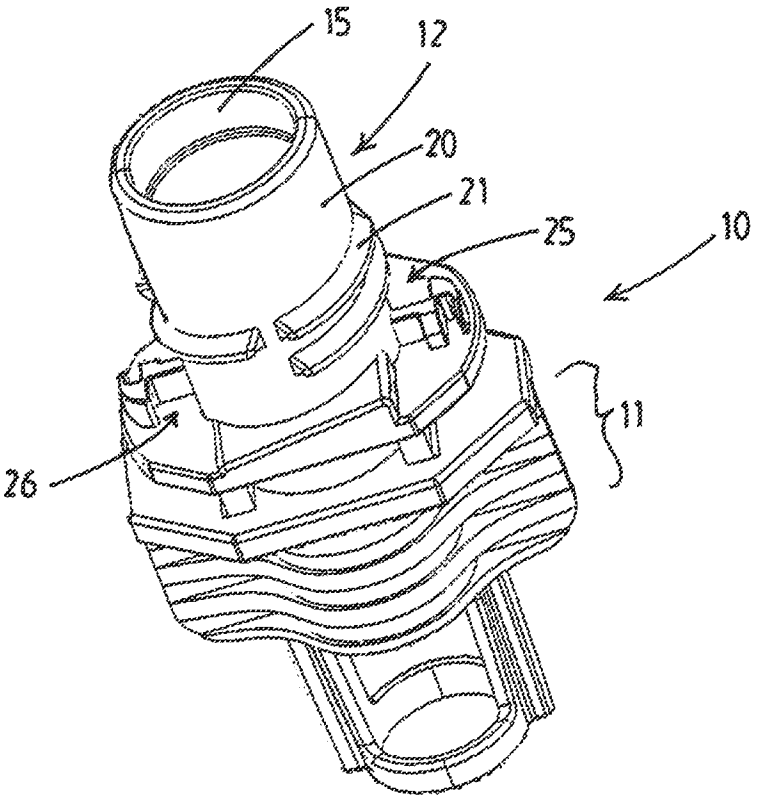
Figure 10:
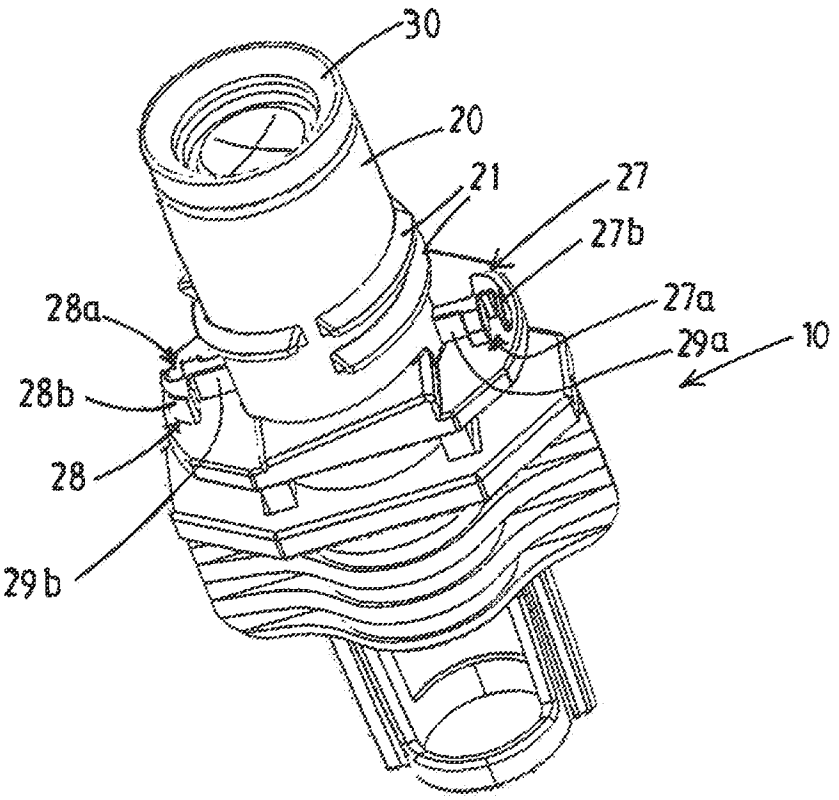
Figure 11:
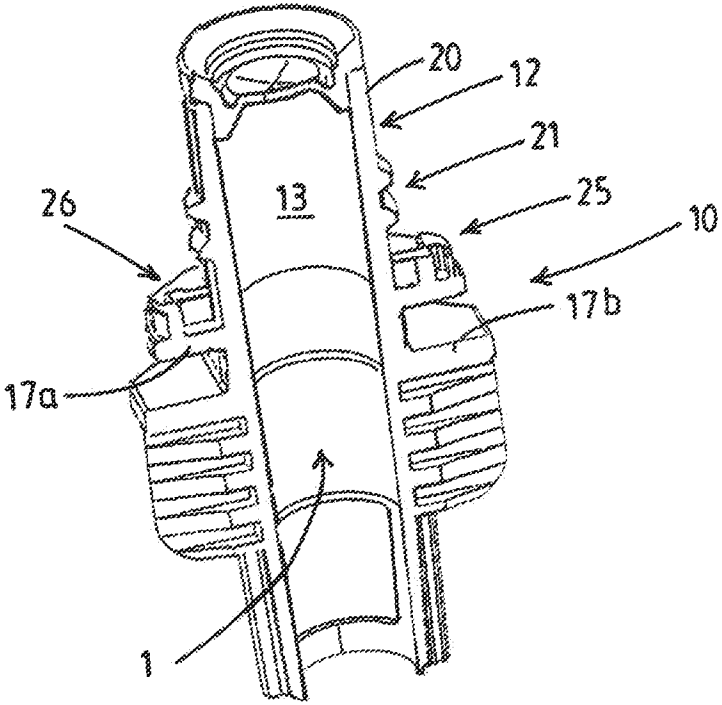
Figure 12:
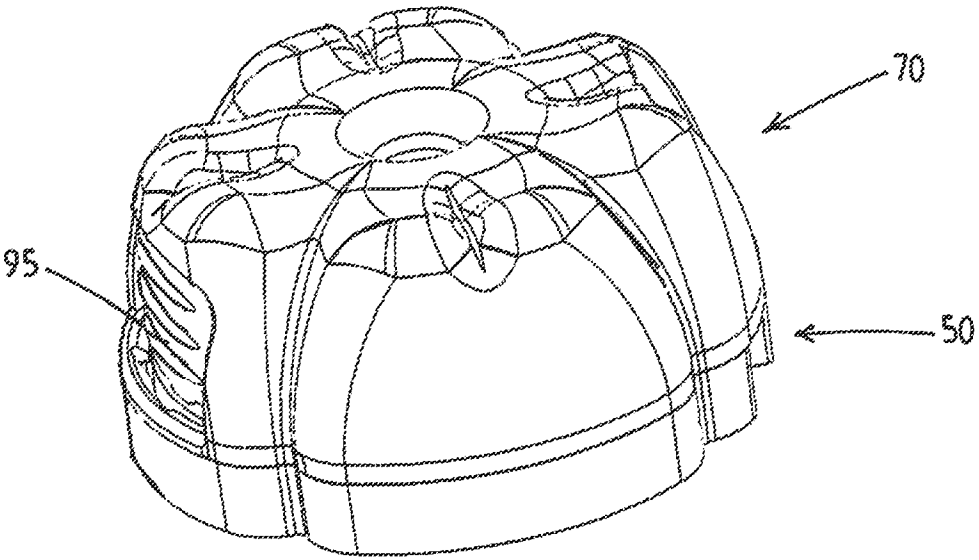
Figure 13:
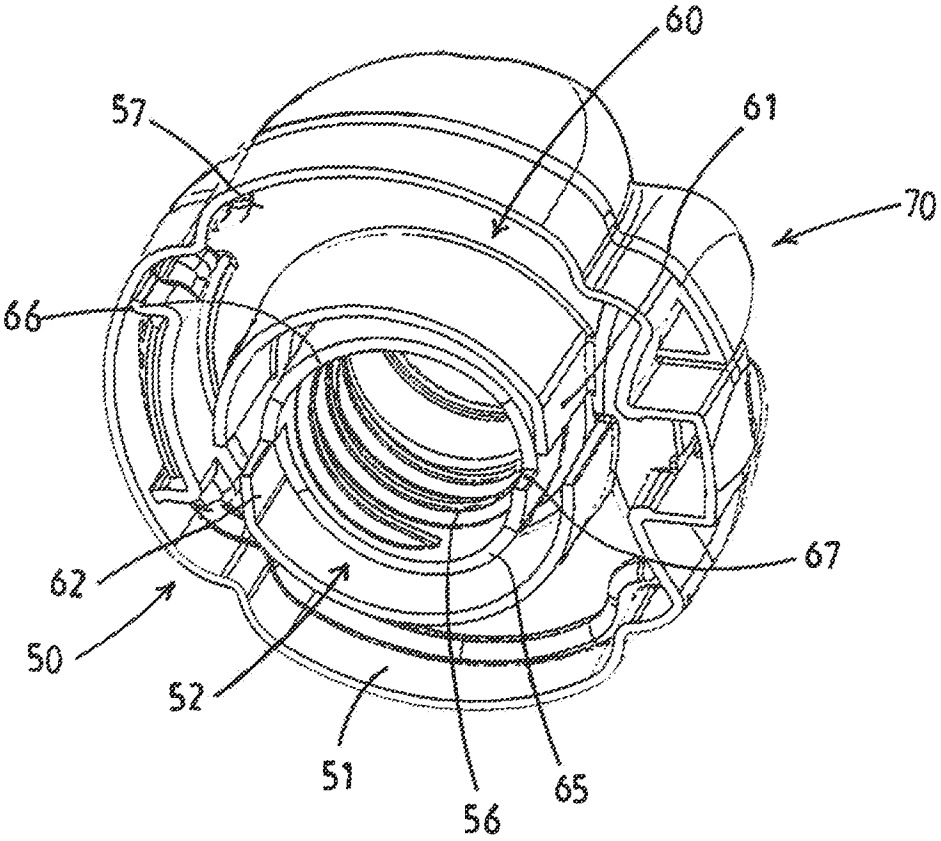
Figure 14A:
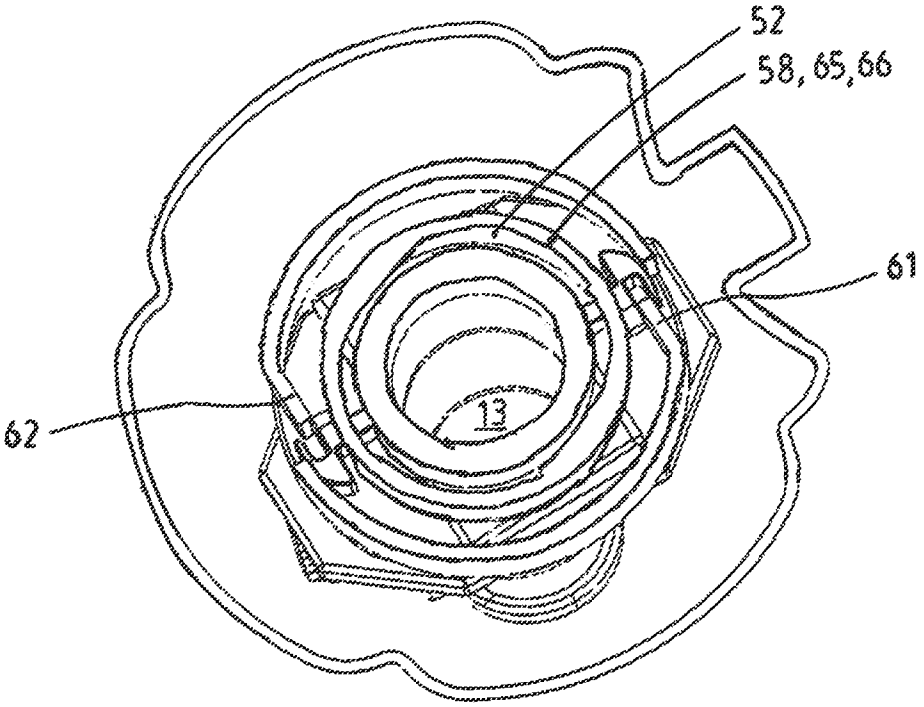
Figure 14B:
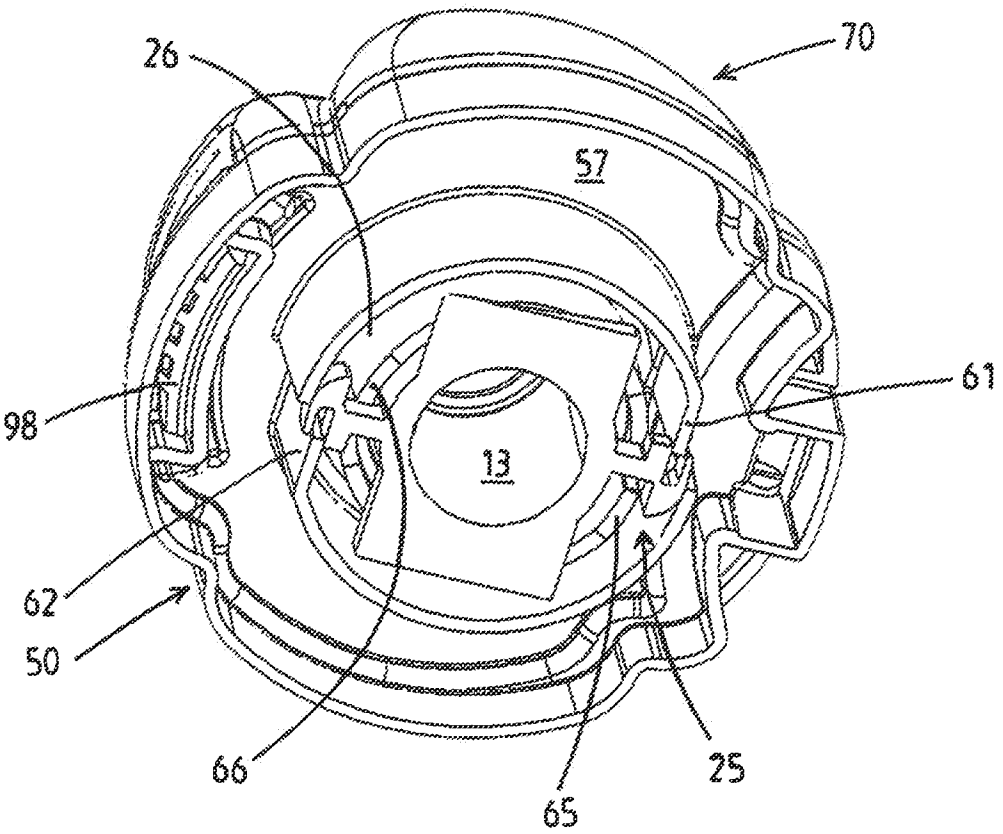
Figure 15:
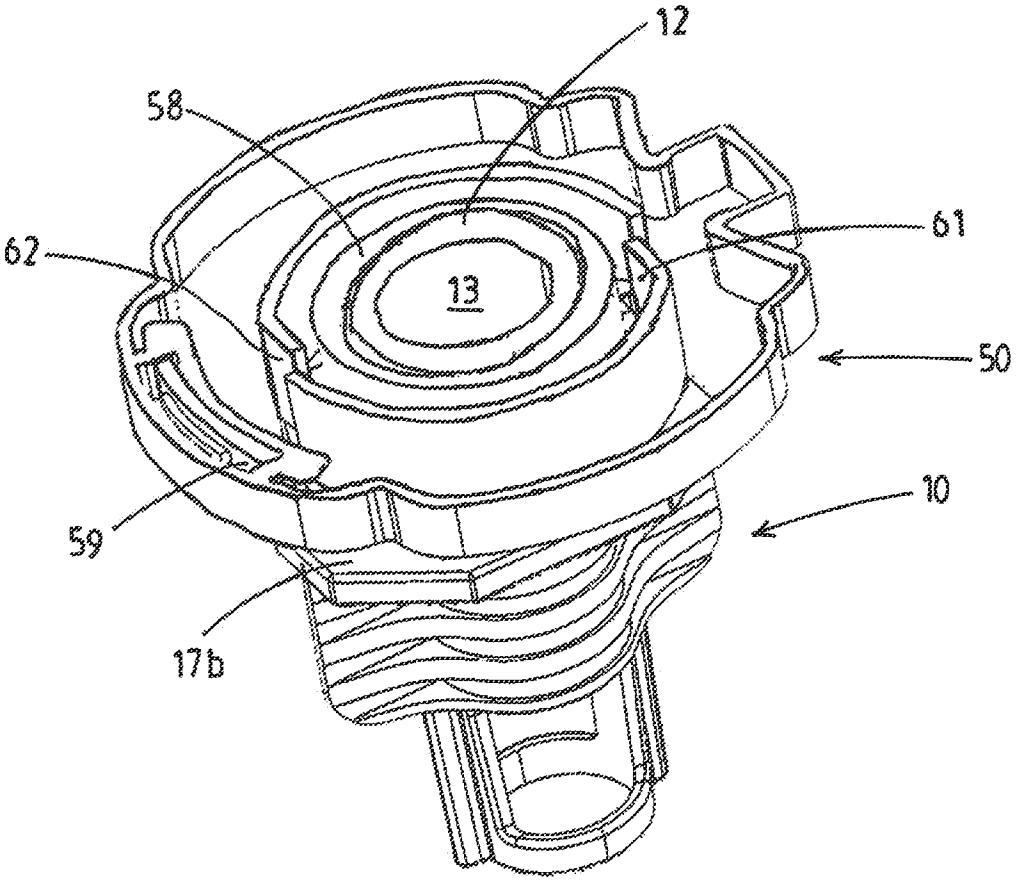
Figure 16:
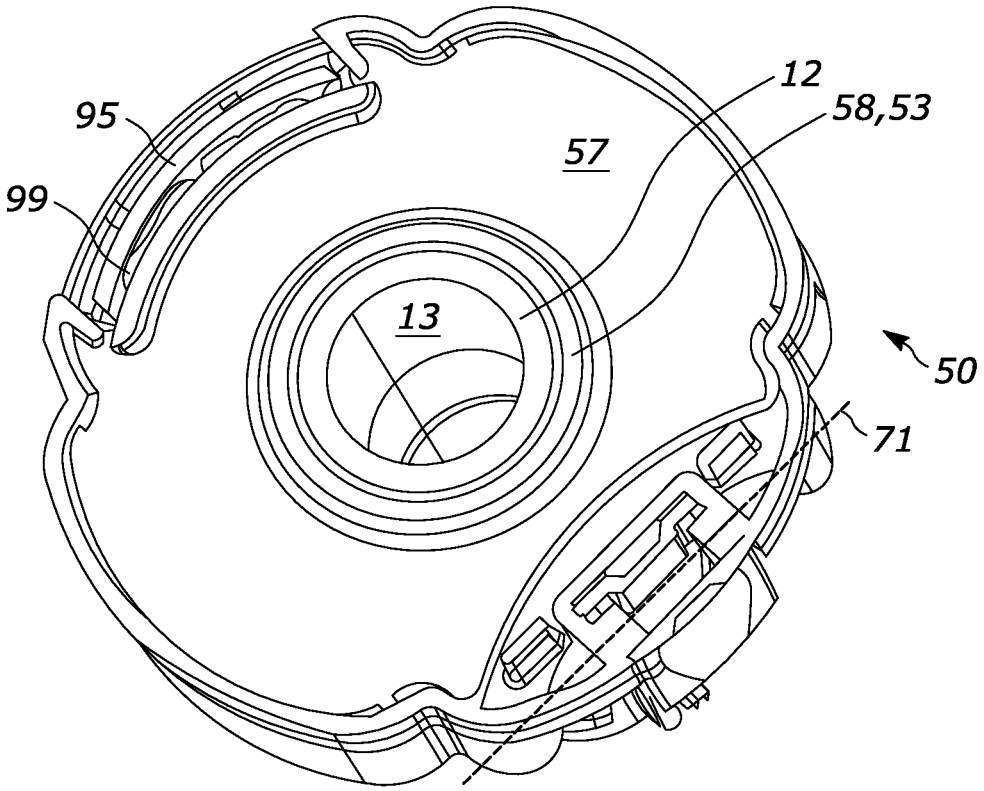
Figure 17:
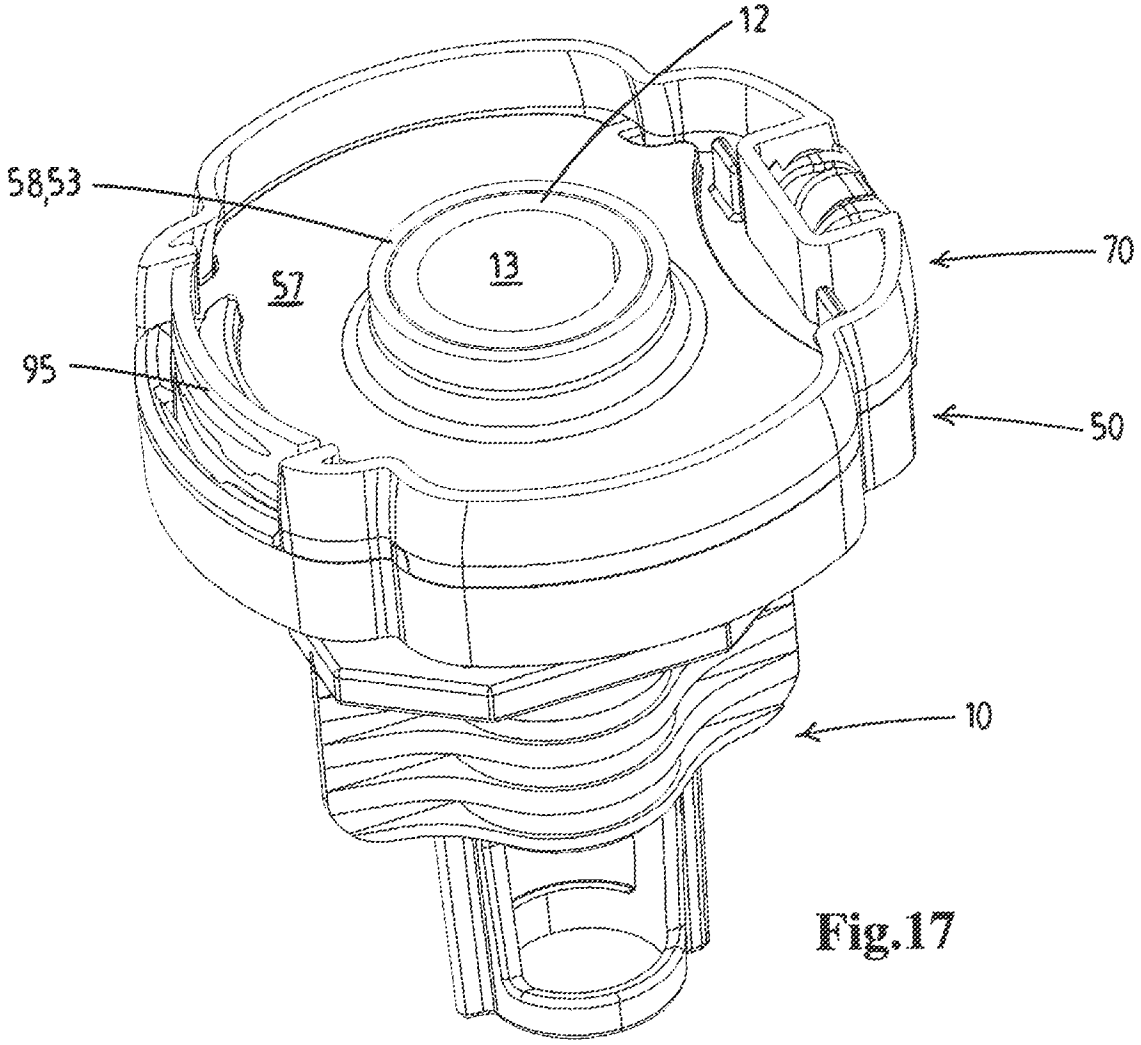
Figure 18:
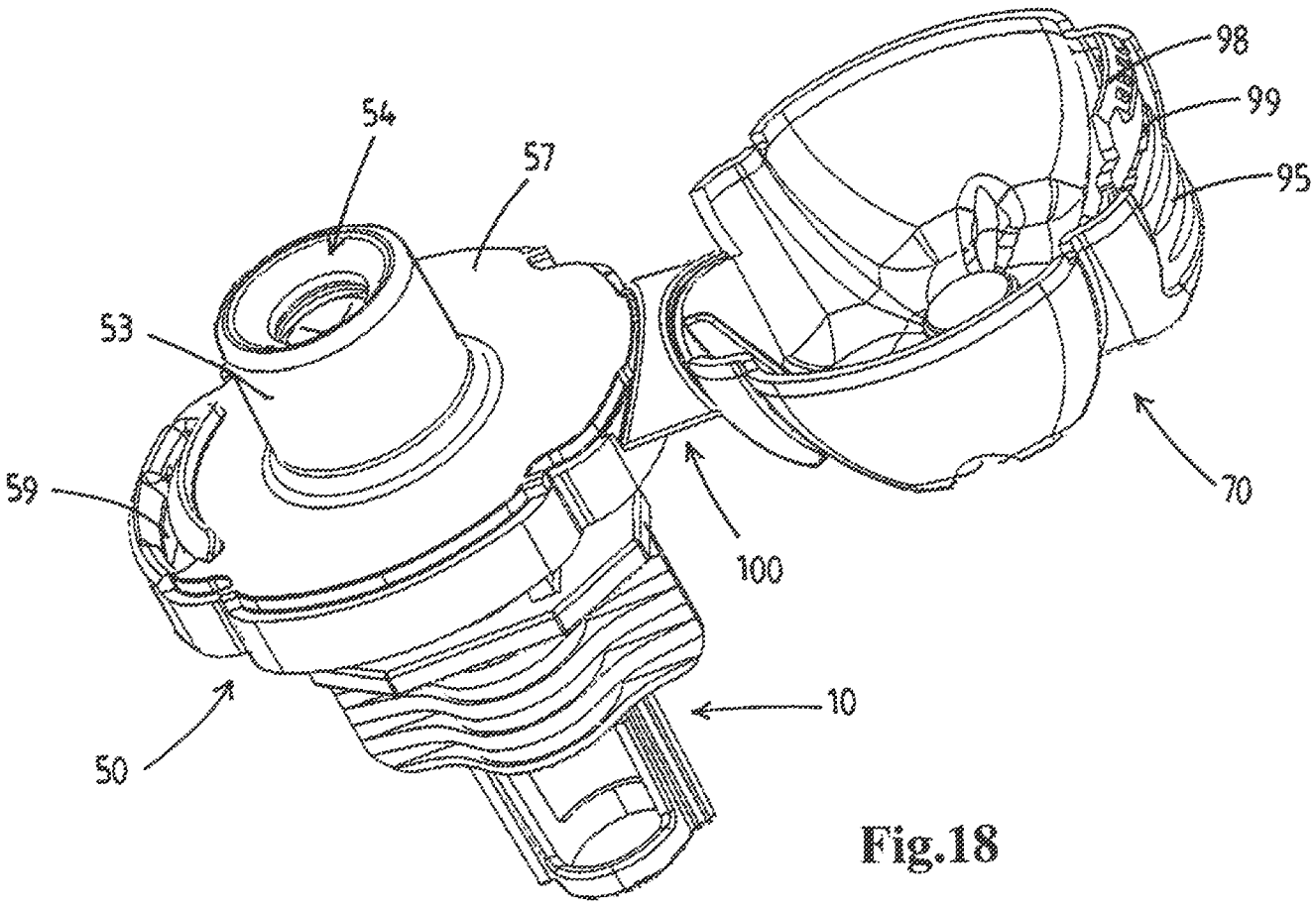
Figure 19:
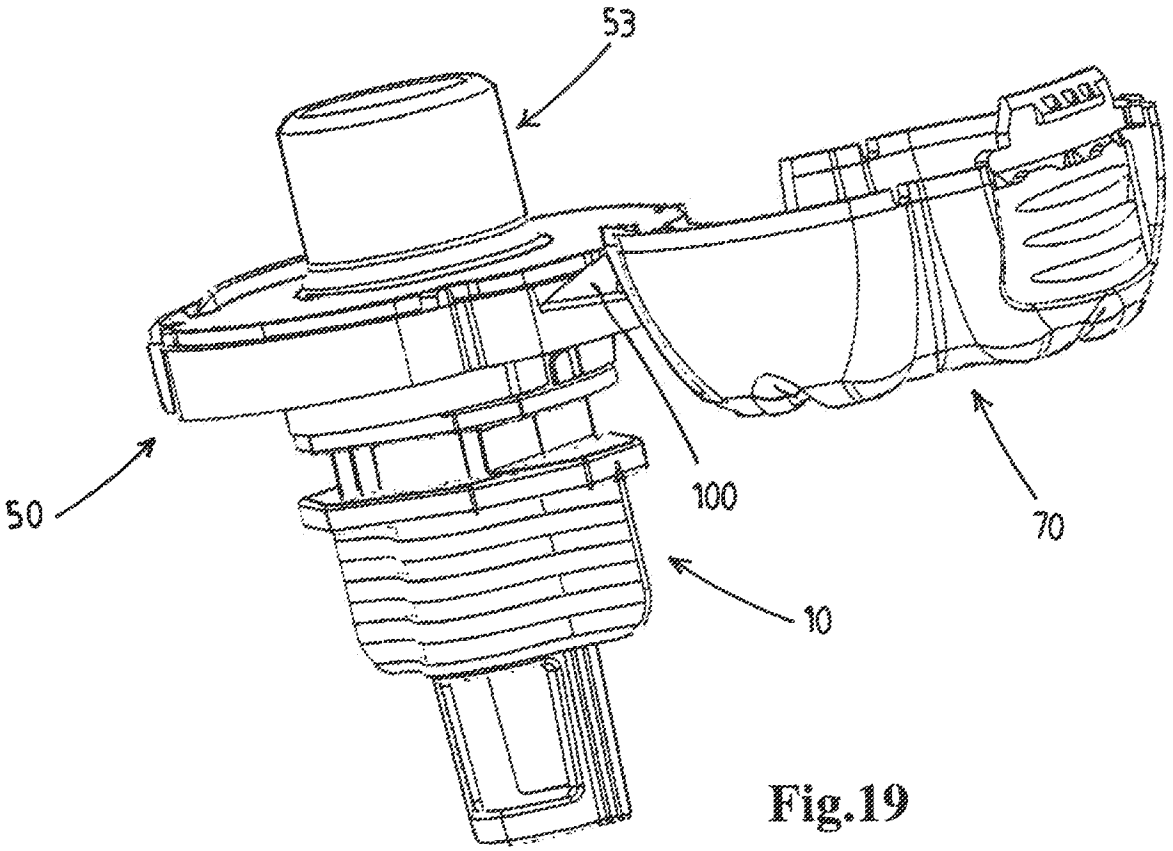
Figure 20:
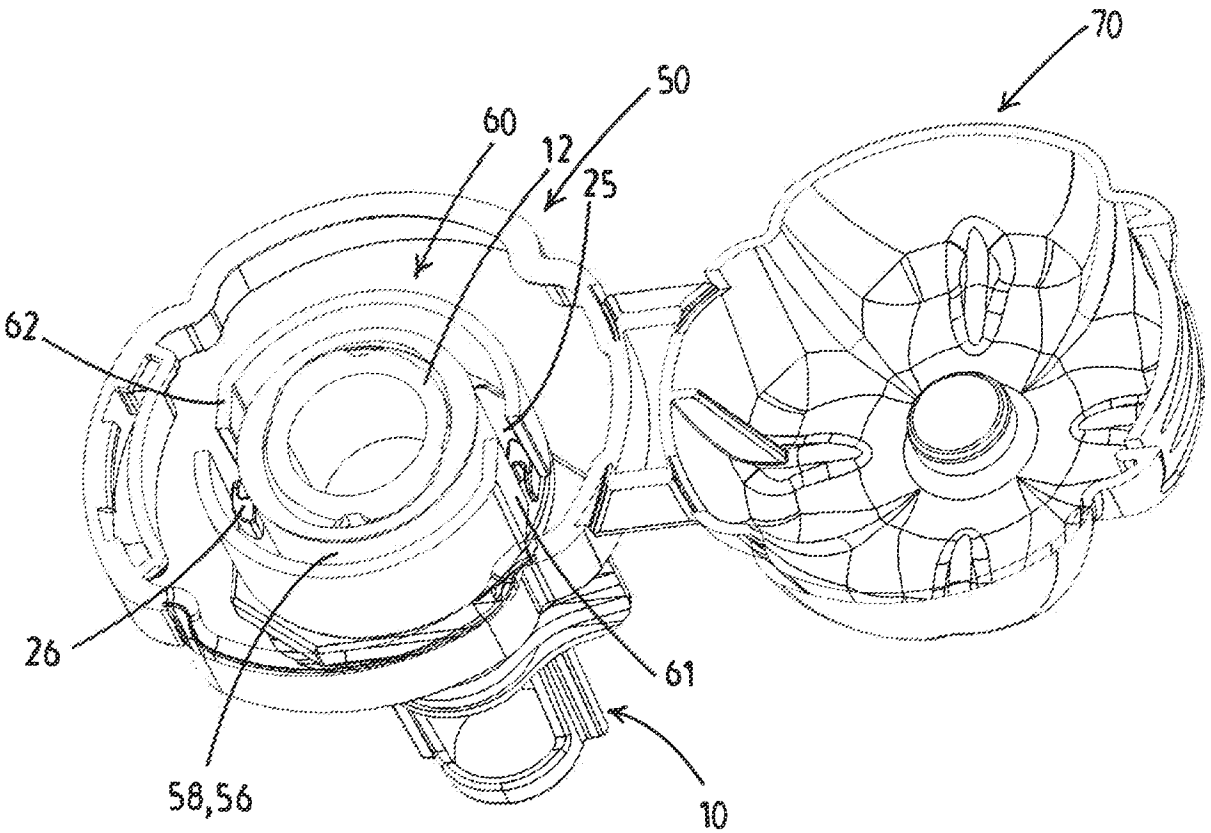
Figure 23:
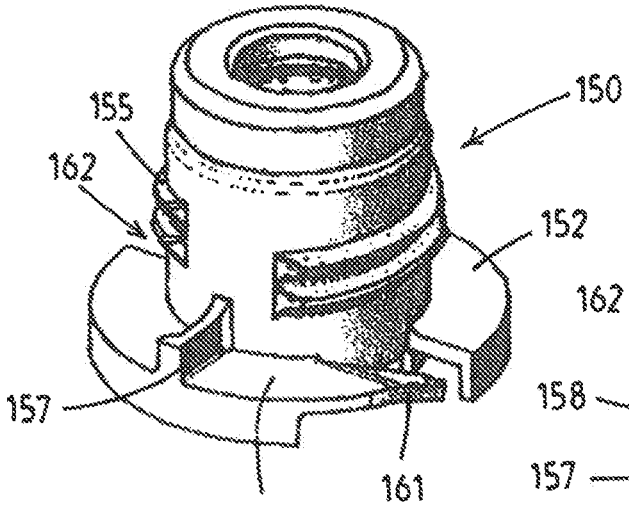
Figure 24:
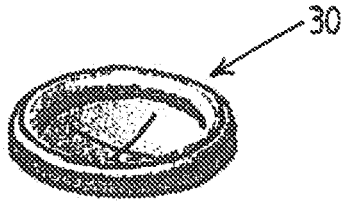
Figure 22:
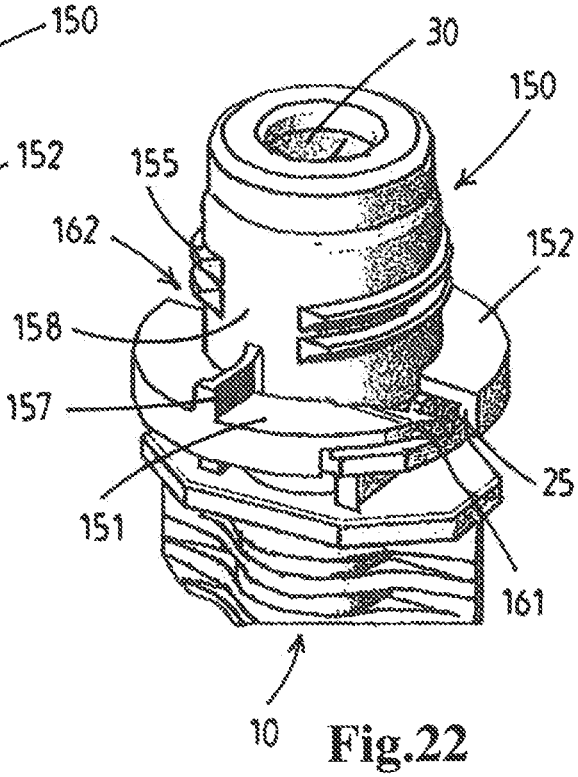
Figure 21:
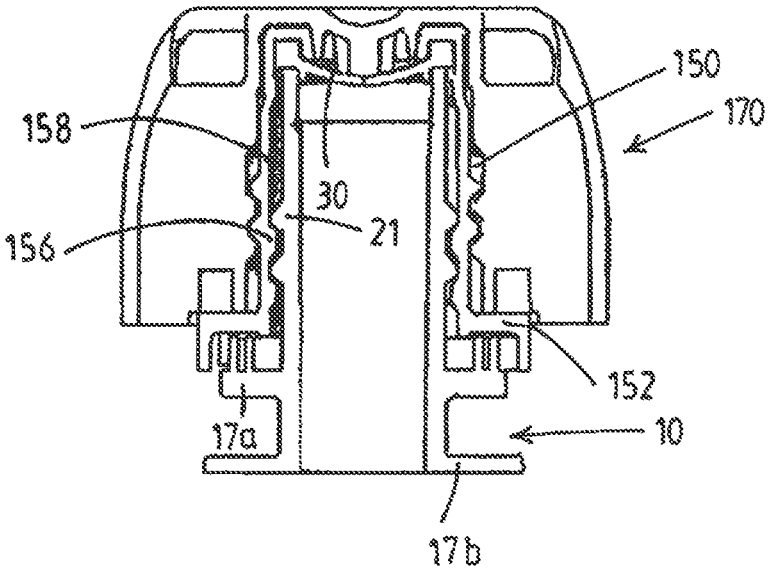
Figure 25:
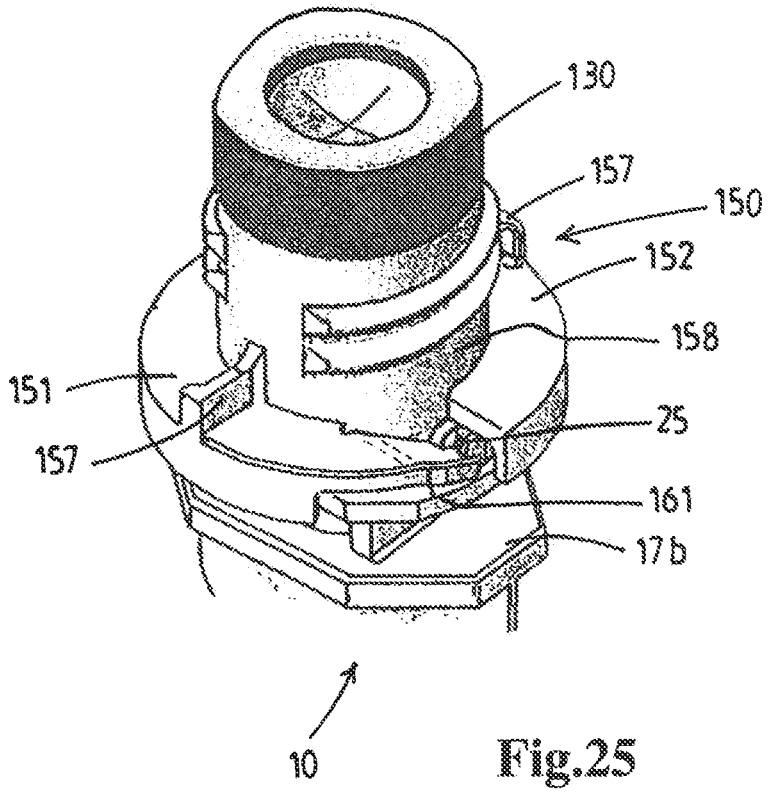

In the drawings:

FIG. 1 shows a first embodiment of a spout, valve, and closure device in perspective view from below, FIG. 2 shows the spout and closure device of FIG. 1 in a first side view, FIG. 3 shows the spout and closure device of FIG. 1 in a second side view, FIG. 4 shows the spout and closure device of FIG. 1 in a third side view, FIG. 5 shows the spout and closure device of FIG. 1 in a fourth side view, FIG. 6 shows the spout and closure device of FIG. 1 in perspective view from above, FIG. 7 shows the spout and closure device of FIG. 1 in a first off-center vertical cross-section, FIG. 8 shows the spout and closure device of FIG. 1 in a second off-center vertical cross-section, FIG. 9 shows the spout of FIG. 1 in perspective view from above, FIG. 10 shows the spout of FIG. 1 as well as the valve in perspective view from above, FIG. 11 shows the arrangement of FIG. 10 in an off-center vertical cross-section, FIG. 12 shows the closure device of FIG. 1 in perspective view from above, FIG. 13 shows the closure device of FIG. 1 in perspective view from below, FIG. 14A shows in a horizontal cross-sectional view the permanent snap lock anti-back off structure of the spout and closure device of FIG. 1, FIG. 14B shows in a horizontal cross-sectional view from below the permanent snap lock anti-back off structure of the spout and closure device of FIG. 1, FIG. 15 shows the arrangement of FIG. 14 in a horizontal cross-section view at a higher level than FIG. 14, FIG. 16 shows the spout with valve and closure device of FIG. 1 in a horizontal cross-section view at a higher level than FIG. 15, FIG. 17 shows the spout with valve and closure device of FIG. 1 in a horizontal cross-section view at a higher level than FIG. 16, FIG. 18 shows a second embodiment of a spout, valve, and closure device in perspective view, with the cap being still open, FIG. 19 shows the second embodiment in a different direction, FIG. 20 shows in a horizontal cross-sectional view the permanent snap lock anti-back off structure of the spout and closure device of FIG. 18, FIG. 21 shows in vertical cross section the upper part of a third embodiment of a spout, valve, and closure device, FIG. 22 shows the third embodiment in perspective view with the screw cap removed, FIG. 23 shows the socket of the third embodiment, FIG. 24 shows the slit valve of the third embodiment, and FIG. 25 shows a variant wherein the slit valve is mounted on top of the socket of the third embodiment.

With reference to FIGS. 1-17 now a first embodiment of a spouted pouch according to the invention will be discussed.

The flexible material pouch body 1 of the spouted pouch is only schematically depicted in FIG. 3, as this is understood to be well-known in the art in all sorts of embodiments.

Besides the pouch body 1, the spouted pouch of the first embodiment comprises a number of main components:

a spout 10, a valve 30, and a closure device 40, that comprises a socket 50 and a cap 70.

The spout 10, best seen in FIG. 9, has a spout body with at a lower end thereof an attachment portion 11 that is attached to the pouch body.

For example the spout 10 is molded of plastic, preferably as a unitary spout body, e.g. of polyethylene PE of polypropylene PP.

The depicted spout 10 is adapted to be secured with the portion 11 thereof between opposed film walls of a collapsible pouch 1. The portion 11 here is essentially boat-shaped or canoe-shaped in horizontal cross-section but other shapes, e.g. oval, elliptical, circular, diamond, etc., are also possible.

The portion 11 is, preferably, heat sealed between opposed film walls of the pouch. Suitable techniques are known in the art.

The spout body has at an upper end thereof a tubular neck 12, which neck has an interior surface delimiting at least a section of a product passage 13 that extends from a lower product passage opening 14 through the spout body to an upper opening 15 at a top end of the neck.

The neck has an exterior surface 20 provided with a first screw thread 21.

The spout body is provided with a rotation preventing boss 25, 26 at a location outward of the neck 12 and below the first screw thread 21.

The closure device 40 is secured on the neck 12 of the spout 10. The closure device 40 comprises:

the socket 50 configured to the screwed onto the neck 12 of the spout 10, the user openable or user removable cap 70 supported on the socket 50 in a manner so as to be openable or removable relative to the socket 50.

The socket 50 comprises a molded socket body 51, preferably unitary, of plastic material having a bore 52 extending through the socket body from a lower end of the socket to a discharge opening 54 at a top end of the socket. The bore 52 is generally delimited by a tubular portion 58 of the body. The bore 52 of the socket is configured to receive at least a portion of the neck 12 of the spout 10 therein. The bore 52 has an interior surface provided with a second or internal screw thread 56 that is configured to cooperate with the first or external screw thread 21 upon screwing the socket 50 onto the neck 12 of the spout 10.

For example, the socket body is molded of PE or PP.

The socket body 51 has an exterior surface of which at least an upper section 53 defines a discharge portion having the discharge opening 54.

The socket body 51 is provided at the lower end thereof with a permanent snap lock anti-back off structure 60 comprising at least one, here two, permanent snap lock anti-back off portion 61, 62 that is configured to flex over the rotation preventing boss 25, 26 upon screwing of the socket 50 onto the neck 12 of the spout 10 and then snap behind said rotation preventing boss 25, 26. The permanent snap lock anti-back off structure 60 is configured to remain intact upon a user opening or removing the cap 70 for the first time and, as preferred, throughout the use period of the spouted pouch, e.g. until the product is emptied from the pouch.

The cap 70, in a closed position thereof, covers the discharge portion 53 and in an opened or removed position clears the discharge portion 53.

The valve 30 here is a slit valve member that is normally closed to close off the product passage 13 and that opens upon application of suitable pressure across the slit valve member 30, e.g. upon squeezing the pouch and/or providing suction on the discharge portion, e.g. the mouthpiece 53.

It is illustrated here that the valve 30 is retained between the top end of the neck 12 of the spout 10 and the socket 50 that is screwed onto the neck of the spout. In alternative embodiments the valve 30 could be retained in the socket or in the spout, e.g. circumferentially retained in a groove in the socket or in the spout, or, for example, co-molded onto the socket or onto the spout.

The closure device 40 is provided with a tamper-evident structure 90 that is configured to visually evidence the first time opening or removal of the cap 70 by the user. Here it is illustrated that the tamper-evident structure 90 including one or more breakable bridges 95 that break upon first time opening of the cap 70 by the user.

It is illustrated here that the closure device 40 is a hinged cap closure device, wherein the cap 70 is a hinged cap, that is hinged to the socket 30, here about a horizontal hinge axis. In the embodiment of FIGS. 1-17 the cap 70 and socket 30 have been made separately, e.g. by injection molding of plastic material, and then the cap 70 has been mounted onto the socket 30. Herein first hinge formations on the socket cooperate with second hinge formations on the cap.

In an alternative embodiment, which will be discussed with reference to a second embodiment shown in FIGS. 18-20, the socket and the hinged cap are integrally molded from plastic material with an intermediate hinge, e.g. a living hinge, between the socket and the hinged cap.

As can be best seen in, for example, FIGS. 7, 9, 13, 14A, 14B, and 15, the spout 10 is provided with two rotation preventing bosses 25, 26 at diametrically opposed locations relative to the neck 12.

The socket 50 is provided with two permanent snap lock anti-back off portions 61, 62 that are each configured to flex radially outward when passing over the rotation preventing boss 25, 26 when the socket 50 is screwed onto the neck 12. These portions 61, 62 then each snap, here radially inward, behind the respective rotation preventing boss 25, 26.

In an alternative embodiment, a permanent snap lock anti-back off portion could be configured to flex axially upward when passing over the rotation preventing boss and then snap downward behind the rotation preventing boss.

In more detail, the socket 50 is provided with two substantially semi-circular permanent snap lock anti-back off portions 61, 62, that each integrally adjoin the deck portion 57 of the socket 50 at a top end of the portion 61, 62. These portions 61,62 extend substantially downward from the deck portion 57, as well as concentric and radially outward relative to the lower section 58*b* of a tubular portion 58 of the socket. These anti-back off portions 61, 62 are each configured to flex radially outward when passing over the rotation preventing boss 25, 26 and then snap radially inward behind the rotation preventing boss with a head end of the anti-back off portion 61, 62 facing the rotation preventing boss 25, 26 when seen in the direction of screwing the socket off the neck 12.

In more detail, as preferred, each rotation preventing boss 25, 26 has a catch portion 27, 28 having or forming a recess 27*a*, 28*a* at a side of the boss facing the head end of portion 61, 62 and having an catch portion outer wall 27*b*, 28*b* with an outer face that is arranged along an inner face of the substantially semi-circular permanent snap lock anti-back off portions 61, 62 when the socket is screwed onto the neck. This is done such that—upon an attempt, or any force acting, to unscrew the socket 30 from the neck 12 of the spout, the head end of the portions 61, 62 enters the respective recess 27*a*, 28*a* of the catch portion 27, 28 and is then prevented from further motion so as to keep the socket on the neck.

The tubular body portion 58 of the socket body 51 defines the bore 52 extending through the socket body 51 from a lower end of the socket to the discharge opening at a top end of the tubular body portion 58.

The deck portion 57 of the socket body 51 forms a deck surface about the tubular body portion 58. Herein an upper section 58*a* of the tubular body portion 58 extending above the deck surface defines the discharge portion 53 having the discharge opening. In embodiments, this portion 53 is embodied as a mouthpiece that the user will take between the lips when drinking a product from the spouted pouch.

A lower section 58*b* of the tubular body portion 58 extends below the deck portion 57. The second screw thread 56 is provided in this lower section 58*b* of the tubular body portion.

As shown here, in an embodiment, the hinged cap 70 is provided with an inward depressable button portion 95 that is integrally molded with the hinged cap 70 and is supported in the cap via one or more button hinge portions 96 of the cap. Here, as preferred, the button portion 95 is hinged along a horizontal upper hinge portion above the button.

A tamper-evident structure 90 is associated with the inwardly depressable button portion 95 to evidence the first time opening of the hinged cap 70.

As shown here, in an embodiment, the inward depressable button portion 95 has a lower edge 97 and an integrally molded latch portion 98 extends downward from the lower edge 97 with one or more breakable bridges 99 being present between the button portion 95 and the latch portion 98. The deck portion 57 is provided with a latch portion receiving structure having an opening 59 into which the latch portion 98 is introduced upon first time closing of the cap 70, e.g. as part of the manufacturing of an assembly of the socket 30 and the cap 70, and is configured to retain the latch portion 98 so that upon first time opening of the hinged cap 70 by a user the one or more breakable bridges 99 break with the latch portion being retained thereby evidencing said first time opening.

The cap 70 has a central depression 80 which forms a central sealing portion and the annular sealing surface 81 thereof. The depression 80 forms a recess in an exterior top face of the cap. The discharge portion 53 comprises an internal annular sealing surface 53*b*.

These sealing surfaces 81, 53*b* are configured to sealingly engage one another in the closed position of the cap 70.

As can be seen the annular sealing surface of the discharge portion is arranged above, or axially outward of, the slit valve member 30.

The socket 50 has an inward bend end portion of which an inner face defines the annular sealing surface 53*b*.

The inward bend end portion of the tubular portion 58 also defines a circumferential groove in which at least a retention portion of slit valve member 30 is retained.

As shown in FIGS. 7, 8, in an embodiment the central depression 80 is configured to extend closely along or be in contact with the slit valve member 30, at least in a zone thereof wherein said one or more slits of the slit valve member 30 are present. Hereby opening of the slit valve 30 due to pressurization of the product in the pouch is blocked as long as the cap 70 is in place and the product will not be able to pass the slit valve 30. This arrangement is equally applicable to hinged cap 70 as well as a screw cap or the like.

As shown a lower edge of the socket body 51 is provided with one or more, here two, downward projecting abutment portions 65, 66 each having an abutment face 67, 68. The rotation preventing bosses 25, 26 of the spout are each embodied with an abutment portion 29*a, b* having an abutment face, so that upon screwing the socket 50 onto the neck 12 each abutment portion 65, 66 of the socket abuts against the corresponding abutment face of the boss and thereby defines the position of the socket 50 fully screwed onto the neck.

As is preferred, the spout 10 is injection molded as a unitary product in a mould.

The product passage in the spout 10 may, in practical embodiments, have a diameter of between 5 and 15 millimeters, for example of about 8 millimeters.

The neck 12 has an exterior side that is provided with screw thread formations 21, here a double screw thread formations as is preferred to provide two 180° angularly offset starting positions for the cap socket 50, e.g. for the pre-assembly of socket 50 and cap 70.

For example, the spout 10 is sealed into a pouch body 1, the pouch is filled via the passage 13 and then the valve 30, followed by the pre-assembly of socket 50 and cap 70 is placed on the neck by one or more automated devices, e.g. including a cap screwing device.

The cap 70, here in conjunction with the valve 30, seals the product passage in closed position of the cap as shown.

It is illustrated that, in the closed position thereof, a lower edge of the hinged cap 70 adjoins the deck portion 57, here along the outer perimeter thereof.

It is illustrated, that, in the closed position thereof, the hinged cap 70 covers the upper section 58*a* of the tubular body portion, which section 58*a* extends above the deck surface defines a mouthpiece 53.

For opening the pouch, the user presses on the button so that the breakable bridges break and the cap 70 can be tilted for opening of the cap.

The figures also show that the spout 10 has two flanges, namely a topmost flange 17*a* and a lower flange 17*b* just above the portion 11. The topmost flange 17*a* is located at a distance above the flange 17*a*.

The flanges 17*a*, 17*b* each protrude outwardly from the neck 12 and extend circumferentially around the neck. In an embodiment each flange could be embodied with two flange parts, each directed away from the neck in opposite directions.

The bosses 25, 26 are raised from the topmost flange 17*a*, are integral therewith at their lower end and are at the inner side also integral directly with the neck 12.

With reference to FIGS. 18-20 now a second embodiment of a spouted pouch according to the invention will be discussed.

As most components and details of the second embodiment correspond to the components of the first exemplary embodiment discussed with reference to FIGS. 1-17, these components and details have been denoted with the same reference numerals and will not be discussed herein.

The main difference between the second and first exemplary embodiments, is that in the second embodiment the cap 70 is hinged to the socket 50 via a living hinge 100. Herein, as preferred, it is envisaged to produce the cap 70 and socket 50 including the living hinge 100 as one unitary plastic part as is generally known in the art.

The hinge, e.g. living hinge, is preferably configured to provide a predetermined stable opened position of the hinged cap relative to the socket. For example a snap mechanism or a stable open folded position of the living hinge. This avoids that the cap moves back to its closed position undesirably.

With reference to FIGS. 21-25 now a third embodiment of a spout, valve, and closure device will be discussed.

In this exemplary embodiment the spout 10 is the same one as discussed with reference to the first embodiment.

The main differences between the third embodiment and the first embodiment are the design of the permanent snap lock anti-back off structure of the socket and the fact that the user removable cap in the third embodiment is a rotational type cap, here a screw cap that is screwed onto the socket.

As can be seen in FIGS. 23, 24 the socket 150 has at least one, here two diametrically arranged, permanent snap lock anti-back off portion 161, 162 which is configured to flex axially upward when passing over the rotation preventing boss 25, 26 and then snap downward behind the rotation preventing boss 25, 26. This in contrast to the example of the first embodiment wherein the flex motion of the portions 61, 62 is primarily outward at first and then inward towards the neck 12.

In more detail, in the FIGS. 21-24 the spout 10 is provided with two rotation preventing bosses 25, 26 at diametrically opposed locations relative to the neck 12. As preferred each boss 25, 26 being arranged on top of an uppermost flange 17*a* of the spout.

In more detail, the FIGS. 21-24 illustrate that the socket 150 comprises two diametrically opposed flange portions 151, 152 that each extend radially outward from a lower section of the socket, e.g. below external thread 155 on the socket 150. Each flange portion 151, 152 has an end facing in a circumferential direction counter to the screw-on direction of the external screw thread 115. From each of said ends of the flange portions 151, 152 a permanent snap lock anti-back off portion 161, 162 protrudes in said direction counter to the external screw thread, e.g. like a resilient finger or tab. Each portion 161, 162 is configured to flex axially upward when passing over the rotation preventing boss 25, 26 during the screwing of the socket 150 onto the neck 12 and is configured to then snap downward behind the rotation preventing boss 25, 26. Once snapped behind the respective boss 25, 26 a permanent snap is obtained.

The cap 170 illustrated here by way of example is of the design as disclosed in WO2014/007612. It will be appreciated that other screw caps can equally be applied on the socket of the third embodiment. Also, instead of a screw cap, another rotational type cap can be applied on the socket. For example a bayonet type cap, with a bayonet engagement between the cap and the socket. Alternatively, for example, a quarter turn type cap that is opened by twisting the cap over about a quarter turn relative to the socket.

As shown the socket 150 is has a tubular portion 158 with an internal thread 156 that mates with the external thread 21 on the neck 12 of the spout 10.

The tubular portion 158 of the socket 150 is further provided with an external thread 155 that mates with the internal thread of the screw cap 170.

The cap 170 seals the discharge opening provided at the top end of the tubular portion of the socket. The cap is embodied to be manually opened by rotation in anti-clockwise direction. As will be understood, the portions 161, 162 prevent the socket 150 from rotating along with the cap 170 upon said opening motion of the cap 170.

In general terms, the cap 170 shown here has an inner cap structure formed by a top wall and a downward depending skirt, the skirt having an interior side, an exterior side, and a lower edge remote from the top wall. The interior side of the skirt has the internal screw thread adapted to cooperate with the external screw thread of the socket 150. The cap 170 also has an outer cap gripping structure, with an annular gripping wall generally concentric relative to inner cap structure and with spokes between the annular gripping wall and the inner cap structure. Air passages may be present in said cap between the inner and outer structure and, possibly, within the outer cap structure.

As preferred, the cap 170 and the socket 150 are provided with cooperating tamper-evident portions forming a tamper-evident structure of the closure device. As an example a tamper-evident structure as disclosed in WO2014/007612 is applied or any other tamper-evident structure wherein the tamper-evident structure includes one or more breakable bridges that break upon rotating the cap in opening direction by the user from its closed position for the first time. Herein the permanent snap lock anti-back off structure, here formed by portions 161, 162 is configured to remain intact upon a user opening or removing the cap for the first time.

In more detail, for example, the socket 150 is provided with an integrally molded rotation preventing boss below the external thread on the socket, e.g. two rotation preventing bosses 157 at diametrically opposed locations relative to the tubular portion 158 of the socket. The related cap 170, e.g. as shown in WO2014/007612, may have a tamper-evident ring that is integrally molded to the skirt of the rotational cap, said tamper-evident ring being composed of at least two ring segments, each ring segment having a base portion and an indicator portion. Herein the base portion is connected via one or more non-frangible connector portions to the skirt, said base portion extending from a trailing end thereof in opening direction over a base portion angle about a main axis, said base portion having an inner face with an inner face radius about the main axis, and wherein the indicator portion is connected at the head end thereof via an integrally molded frangible bridge to an adjacent trailing end of a base portion of another ring segment. The socket has for each ring segment of the tamper-evident ring a rotation preventing boss, said boss being arranged to be engaged by a corresponding head end of an indicator portion of the segment. The cap with tamper-evident ring is embodied such that upon rotating the cap in opening direction by the user from its closed position for the first time, the head end of the indicator portion engages the boss which then prevents the head end from further motion in opening direction of the cap, the frangible bridge between said head end and the trailing end of the base portion breaking, and the indicator portion being subjected to permanent deformation. The detailed disclosure of WO2014/007612 being considered incorporated herein by reference.

Each rotation prevention boss 157 may have a catch portion having a recess at a side of the boss facing the head end of the indicator portion and having an catch portion outer wall with an outer face that is arranged along the inner face of the base portion near the trailing end thereof when said cap is in its closed position, wherein the head end of the indicator portion is arranged at a spacing radially inward from the trailing end of the adjacent base portion when said cap is in its closed position, such that—upon rotating the cap 150 in opening direction by the user from its closed position for the first time—the head end of the indicator portion enters the recess of the catch portion and is then prevented from further motion in opening direction of the cap, whilst the catch portion outer wall comes in the spacing between the spaced apart head end and trailing end, the frangible bridge between said head end and trailing end breaking and the indicator portion bending, folding, and/or buckling whilst being subjected to permanent deformation upon further rotation of the cap in opening direction.

FIGS. 21-24 illustrate that a valve 30 may be provided, e.g. a slit valve as shown here. In this example the valve 30 is sandwiched between the top end of the neck 12 of the spout 10 and the socket 150 that is screwed onto the neck of the spout 12.

FIG. 24 illustrates a variant of the socket 150. Here a valve 130, here a slit valve 130, is co-molded onto the tubular portion 158 of the socket 150 at the upper end thereof.

The invention claimed is:

1. A spouted pouch comprising:

a flexible material pouch body (1), a spout (10) having a spout body with at a lower end thereof an attachment portion (11) that is attached to the pouch body, wherein said spout body has at an upper end thereof a tubular neck (12), which neck has an interior surface delimiting at least a section of a product passage (13) that extends from a lower product passage opening through the spout body to an upper opening (15) at a top end of the neck, said neck having an exterior surface provided with a first screw thread (21), wherein the spout body is provided with a rotation preventing boss (25,26) at a location outward of the neck and below said first screw thread (21), a closure device (40) that is secured on said neck (12) of the spout, wherein said closure device comprises:

a socket (50;150) configured to the screwed onto the neck of the spout, a user openable hinged cap (70;170) supported on the socket in a manner so as to be openable or removable relative to the socket, wherein the socket (50;150) comprises a molded socket body of plastic material, which socket body has a tubular body portion (58) defining a bore (52) extending through the socket body from a lower end of the socket body to a discharge opening (54) at a top end of the tubular body portion, wherein the bore (52) receives at least a portion of the neck (12) of the spout therein, wherein the bore has an interior surface provided with a second screw thread (56) that cooperates with the first screw thread (21), and wherein the socket body has a deck portion (57) forming a deck surface about the tubular body portion (58), wherein a lower section (58*b*) of the tubular body portion (58) extends below the deck portion, wherein the second screw thread (56) is provided in said lower section (58*b*) of the tubular body portion, and wherein an upper section (58*a*) of the tubular body portion extends above the deck surface and defines a discharge portion (53) having said discharge opening, wherein the socket body is provided at the lower end thereof with a permanent snap lock anti-back off structure (60) comprising at least one permanent snap lock anti-back off portion (61,62;161,162) that has been flexed over the rotation preventing boss (25,26) upon screwing of the socket (50;150) onto the neck of the spout and then snapped behind said rotation preventing boss, wherein said permanent snap lock anti-back off structure is configured to remain intact upon a user opening the cap (70;170) for the first time, wherein the hinged cap (70;170) is hinged to the deck portion and, in a closed position thereof, covers the discharge portion (53).

2. A spouted pouch according to claim 1, wherein the permanent snap lock anti-back off portion (61,62) have flexed radially outward when passing over the rotation preventing boss (25,26) and then snapped radially inward behind the rotation preventing boss.

3. A spouted pouch according to claim 1, wherein the permanent snap lock anti-back off portion (161,162) have flexed axially upward when passing over the rotation preventing boss (25,26) and then snapped downward behind the rotation preventing boss.

4. A spouted pouch according to claim 1, wherein the closure device (40) is provided with a tamper-evident structure (90;95,99) that is configured to visually evidence the first time opening of the cap (70;170) by the user, said tamper-evident structure including one or more breakable bridges that break upon first time opening of the cap by the user.

5. A spouted pouch according to claim 1, wherein a slit valve member (30;130) is provided that is normally closed to close off the product passage and that opens upon application of a pressure across the slit valve member.

6. A spouted pouch according to claim 5, wherein the slit valve member (30) is one of:

retained in the socket, retained between the socket (50) and the neck (12) of the spout, co-molded onto the socket (150).

7. A spouted pouch according to claim 1, wherein the socket and the hinged cap are integrally molded from plastic material with a living hinge (100) between the socket and the hinged cap.

8. A spouted pouch according to claim 1, wherein the hinged cap (70) is provided with an inward depressable button portion (95) that is integrally molded with at least the hinged cap and is supported in the cap via one or more button hinge portions (96) of the cap, wherein a tamper-evident (98,99) is associated with the inwardly depressable button portion to evidence the first time opening of the hinged cap.

9. A spouted pouch according to claim 8, wherein the inward depressable button portion has a lower edge (97), and wherein an integrally molded latch portion (98) extends downward from said lower edge with one or more breakable bridges (99) being present between said button portion and said latch portion, wherein the deck portion (57) of the socket body is provided with a latch portion receiving structure having an opening (59) into which said latch portion (98) is introduced upon first time closing of the cap and being configured to retain the latch portion so that upon first time opening of the hinged cap by a user said one or more breakable bridges (99) break with the latch portion being retained thereby evidencing said first time opening.

10. A spouted pouch according to claim 1, wherein the spout (10) is provided with two rotation preventing bosses (25,26) at diametrically opposed locations relative to the neck (12), and wherein the socket is provided with two substantially semi-circular permanent snap lock anti-back off portions (61,62) that each integrally adjoin the deck portion at a top end thereof and extend substantially downward from the deck portion, as well as concentric and radially outward relative to the lower section of the tubular portion (58) of the socket, which anti-back off portions (61,62) have been flexed radially outward when passing over the rotation preventing boss and then snapped radially inward behind the rotation preventing boss with a head end of the anti-back off portion facing the rotation preventing boss.

11. A spouted pouch according to claim 10, wherein each boss (25,26) has a catch portion (27,28) having or forming a recess (27*a*,28*a*) at a side of the boss facing the head end and having an catch portion outer wall (27*b*,28*b*) with an outer face that is arranged along an inner face of the substantially semi-circular permanent snap lock anti-back off portions when the socket is screwed onto the neck, such that—upon an attempt to unscrew the socket from the neck of the spout, the head end enters the recess (27*a*,28*a*) of the catch portion (25,26) and is then prevented from further motion so as to keep the socket on the neck.

12. A spouted pouch according to claim 1, wherein said hinged cap comprises a central sealing portion (80) having an annular sealing surface (81), and wherein the discharge portion (53) comprises an annular sealing surface (53*b*), said sealing surfaces being configured to sealingly engage one another in the closed position of the hinged cap.

13. A spouted pouch according to claim 1, wherein a lower edge of the socket is provided with one or more downward projecting abutment portions (65,66), each embodied as a downward extension of a tubular portion (58,58*b*) of the socket, each abutment portion (65,66) having an abutment face, and wherein the one or more rotation preventing bosses (25,26) of the spout are each embodied with an corresponding abutment portion (29*a*,29*b*) having an abutment face (67), so that each abutment portion (65,66) of the socket abuts against the corresponding abutment face of the boss (25,26).

* * * * *